US011211042B2

(12) United States Patent
Corin

(10) Patent No.: US 11,211,042 B2
(45) Date of Patent: Dec. 28, 2021

(54) SOUND DAMPING DEVICE FOR A DUCT OR CHAMBER

(71) Applicant: Sontech International AB, Kungsängen (SE)

(72) Inventor: Ralf Corin, Saltsjöbaden (SE)

(73) Assignee: SONTECH INTERNATIONAL AB, Kungsaangen (SE)

( * ) Notice: Subject to any disclaimer, the term of this patent is extended or adjusted under 35 U.S.C. 154(b) by 531 days.

(21) Appl. No.: 16/098,453

(22) PCT Filed: May 4, 2017

(86) PCT No.: PCT/EP2017/060712
§ 371 (c)(1),
(2) Date: Nov. 2, 2018

(87) PCT Pub. No.: WO2017/191286
PCT Pub. Date: Nov. 9, 2017

(65) Prior Publication Data

US 2019/0147842 A1 May 16, 2019

Related U.S. Application Data

(60) Provisional application No. 62/331,700, filed on May 4, 2016.

(30) Foreign Application Priority Data

May 4, 2016 (EP) ..... 16168396

(51) Int. Cl.
*G10K 11/168* (2006.01)
*F01N 1/10* (2006.01)
(Continued)

(52) U.S. Cl.
CPC ..... *G10K 11/168* (2013.01); *F01N 1/10* (2013.01); *G10K 11/17861* (2018.01); *F01N 1/08* (2013.01)

(58) Field of Classification Search
CPC .. G10K 11/168; G10K 11/17861; F01N 1/10; F01N 1/08
(Continued)

(56) References Cited

U.S. PATENT DOCUMENTS 6,821,607 B2 * 11/2004 Zwick ..... B32B 3/28 181/290
7,661,510 B2 * 2/2010 Muller ..... G10K 11/168 181/292
(Continued)

FOREIGN PATENT DOCUMENTS

DE 1201528 B 9/1965
DE 3022850 A1 1/1982
(Continued)

*Primary Examiner* — Forrest M Phillips
(74) *Attorney, Agent, or Firm* — Eckert Seamans Cherin & Mellott, LLC

(57) ABSTRACT

A sound damping device adapted to be arranged inside a duct, comprises a first element (40*a*) including at least one first wall (20*a*) of a first channel (12*a*) having a first channel inlet (13*a*) and a first channel outlet (13*b*), a second element (40*b*) including at least one second wall (20*a*) of a second channel (16*a*) having a second channel inlet (14*b*) and a second channel outlet (14*b*), said and outlet regions being substantially opposite to one another, wherein at least a portion of at least one of said first and second elements (40*a*, 40*b*) comprises an acoustic energy dissipative sheet material. In accordance with the invention, said first element (40*a*) comprises a guide means (21) further defining said first channel (12*a*); said second element (40*b*) comprises a second guide means (21) further defining said second channel (16*a*); and said first and second guide means (21) are
(Continued)

arranged in relation to one another in such a way that the first channel (12*a*) forms a first angle in relation to the second channel (16*a*).

44 Claims, 14 Drawing Sheets

(51) Int. Cl.
*G10K 11/178* (2006.01)
*F01N 1/08* (2006.01)

(58) Field of Classification Search
USPC ..... 181/290
See application file for complete search history.

(56) References Cited

U.S. PATENT DOCUMENTS 9,704,467 B1 * 7/2017 Nampy ..... G10K 11/172
10,190,312 B2 * 1/2019 Flotre ..... E04B 1/8409
2004/0074694 A1 * 4/2004 Heed ..... G10K 11/168 181/228
2009/0050404 A1 * 2/2009 Corin ..... F01N 1/083 181/279
2009/0090580 A1 * 4/2009 Hotzeldt ..... G10K 11/168 181/290
2020/0143785 A1 * 5/2020 Garnier ..... G10K 11/168

FOREIGN PATENT DOCUMENTS

DE 93 00 388.9 U1 4/1993
DE 4141855 A1 6/1993
DE 94 02 754.4 U1 6/1994
DE 101 21 940 C1 1/2003
EP 2 810 770 A1 12/2014
EP 3450738 A1 * 3/2019 ..... F02C 7/045
WO 9727370 A1 7/1997
WO 9934974 A1 7/1999
WO 02064953 A1 8/2002
WO 2006098694 A1 9/2006
WO 2007040265 A1 4/2007
WO 2013124069 A2 8/2013

* cited by examiner

SOUND DAMPING DEVICE FOR A DUCT OR CHAMBER

TECHNICAL BACKGROUND OF THE INVENTION

The present invention relates to a sound damping device adapted to be arranged inside a duct, comprising a first element including at least one first wall of a first channel having a first channel inlet and a first channel outlet, a second element including at least one second wall of a second channel having a second channel inlet and a second channel outlet, said first and second elements together forming a stack or roll having an inlet region and an outlet region, said inlet and outlet regions being substantially opposite to one another, wherein at least a portion of at least one of said first and second elements comprises an acoustic energy dissipative sheet material.

Such a sound damping device is known from WO 2006/098694, disclosing a stack of plates made of an acoustic energy dissipative sheet material in the flow direction of a flow channel.

An acoustic energy dissipative sheet material in the form of micro-slit sheets is known from WO 97/27370.

Another acoustic energy dissipative sheet material in the form of micro-cracks in sheets is known from WO 99/34974.

In DE-C-101 21 940 is described sound absorbing elements arranged in such a way that all the channels are parallel to one another as well as to the flow direction.

DE-U-9300388 discloses a sound damper having a square shaped housing and containing sound absorbents arranged parallel to one another and parallel to the flow direction.

DE-U-9402754 discloses a similar kind of sound damper.

In DE-B-1 201 528, a first group of sound absorbers are arranged at an angle to one another in a diverging relationship in relation to the flow direction. A second group of sound absorbers are arranged at an angle to one another in a converging relationship in relation to the flow direction.

The first and second groups of sound absorbers are arranged after one another in the flow direction.

In ventilation ducts, sound dampers provided with sound damping members across the flow direction, such as baffles cause an undesired pressure drop. WO 02/064953 discloses a sound damper arranged inside a chamber connected to a duct. The division of the flow of the duct in a much larger chamber and forcing it in opposite directions lateral to the flow inside the duct, and back again into the duct, causes an undesired pressure drop of the flow, even larger than that of the use of baffles.

SUMMARY OF THE INVENTION

An object of the invention is to provide a sound damping device having improved sound damping properties substantially without affecting the flow through a duct into which the sound damper is fit.

This object has been achieved by a sound damping device of the initially defined kind, wherein said first element comprises a guide means further defining said first channel; wherein said second element comprises a second guide means further defining said second channel; and wherein said first and second guide means are arranged in relation to one another in such a way that the first channel forms a first angle in relation to the second channel.

Hereby, acoustic energy losses are achieved directly in the channel walls between the walls of the channels inclined in relation to the general flow of the duct Thus, the different directions of the channels will create a local pressure difference over the energy dissipative walls, such that acoustic energy will be dissipated.

Furthermore, a reduced manufacture cost is achieved compared to sound dampers comprising soft sound damping material.

Suitably, said guide means comprises a guide member close to the inlet of the first channel and wherein said second guide means comprises a guide member close to the inlet of the second channel. Hereby, the inlet of the first and second channels is further defined.

Preferably, said guide means comprises a further guide member close to the outlet of the first channel and wherein said second guide means comprises a further guide member close to the inlet of the second channel. Hereby, the inlet of the first and second channels is even further defined.

Suitably, said guide member and further guide member of said guide means together define said first channel laterally, and wherein said guide member and further guide member of said second guide means together define said second channel laterally. Hereby, the outlet of the first and second channels is even further defined.

Preferably, the total cross-section of the first channel and the second channel corresponds substantially to that of the cross-section of the channel inside which the sound damping device is adapted to be mounted, such that the sound damping device does not cause a substantial pressure drop from the inlet to the outlet of the first and second channels, respectively. Hereby is achieved an efficient sound damping device with low flow resistance.

Suitably the first angle is in the range 10°-150°, more particular 30°-140°, even more particular 40°-100°, most particular 60°-94°. Hereby is achieved a sound damper with low pressure drop.

Suitably, the sound damping device further comprises a third element including at least one third wall of a third channel having an inlet and an outlet, a fourth element including at least one fourth wall of a fourth channel having an inlet and an outlet, said third and fourth elements together forming a stack or roll together with the said first and second elements, wherein at least a portion of at least one of said third and fourth elements comprises an acoustic energy dissipative sheet material, wherein said third element comprises a guide means further defining said third channel; in that said fourth element comprises a guide means further defining said second channel; said third element being arranged in relation to said second element in such a way that the third channel forms a second angle in relation to the second channel; said fourth element being arranged in relation to said third element in such a way that the third channel forms a third angle in relation to the fourth channel.

Hereby, a stack of four elements is achieved.

Preferably, the first and third channels are directed in substantially the same direction, and wherein the second and fourth channels are directed in substantially the same direction. Hereby is achieved four channels dividing the general flow in two angled flows.

Suitably, said third guide means comprises a guide member close to the inlet of the third channel and wherein said fourth guide means comprises a guide member close to the inlet of the fourth channel, and wherein said third guide means comprises a further guide member close to the outlet of the third channel and wherein said fourth guide means comprises a further guide member close to the inlet of the fourth channel.

Preferably, said guide member and further guide member of said third guide means together define said third channel laterally, and wherein said guide member and further guide member of said fourth guide means together define said second channel laterally.

Suitably, the second angle is in the range 10°-150°, more particular 30°-140°, even more particular 40°-100°, most particular 60°-94°.

The third angle preferably corresponds substantially to the first angle. It should however be understood that the first and third channels angled in relation to one another and the second and fourth channels angled in relation to one another, as long as the first and third channels are angled away from the second and fourth channels.

Preferably, at least one of said elements includes the wall of a neighbouring element. Hereby, a compact stack of elements is achieved.

Alternatively, at least one of said elements includes an intermediate wall separating said element from a neighbouring element. Hereby, a stack of individual elements is achieved.

Preferably, at least every second wall is provided with protrusions and/or indentations, constituting distance holding members in relation to a neighbouring wall. Hereby, it is possible to build up the stack without use of separate distance holding members. Alternatively, each wall is provided with protrusions and/or indentations, constituting distance holding members in relation to a neighbouring wall.

Suitably, the protrusions and/or indentations are arranged such that the cross-sectional area of said channels is substantially constant. Hereby is achieved a low pressure drop over the stack of elements.

Preferably, a housing or frame is adapted to support said stack or roll of elements, said housing or frame being adapted to fit inside said duct. Hereby, the stack or roll of elements can be readily and easily installed into said duct. Furthermore, since it is possible to produce a standardised product of predetermined size, such as an insert silencer, in a duct or chamber. This adds to lowering the production costs and labour costs during installation.

Suitably, said frame or housing is adapted to keep the stack of roll of elements inside said channel in such a way that a bisector of the inlets of the first and second channels is directed substantially in the flow direction of said channel.

Hereby is achieved a substantially symmetrical flow pattern at the inlet of the stack or roll of elements.

In addition, the frame or housing may be adapted to keep the stack of roll of elements inside said channel in such a way that a bisector of the outlets of the first and second channels is directed substantially in the flow direction of said channel, for achieving a substantially symmetrical flow pattern at the outlet of the stack or roll of elements.

Suitably, wherein the total cross-sectional area of the channels of the elements is at least 70% of the cross-sectional area of said stack, preferably at least 90% of the cross-sectional area of said stack, more particular at least 95% of the cross-sectional area, most particular at least 97% of the cross-sectional area of said stack. Hereby, sound absorption is achieved without substantially influencing the flow in the duct, i.e. the larger the total cross-sectional area of the channel, the lower the flow resistance, or in other words, the smaller the total cross-sectional area of the walls of the stack, the lower the flow resistance.

Preferably, said walls are formed as plates, said plates being shaped as a parallelogram, such as a rectangle, a square, a rhombus or a disc.

Hereby is achieved a lower transversal dimension than e.g. walls made of soft sound absorption material. Thus, walls made of soft sound absorption material are less suitable than walls comprising of micro-perforated plates, since soft sound absorption material requires transversal.

Thus, the transversal dimension of walls made of plates is substantially not affected by the sound absorbing sheet material.

Furthermore, such material of a sound damping device can be readily and easily cleaned.

Suitably said acoustic energy dissipative sheet material is made of any one of plastic, metal, hard metal and ceramics.

Hereby, it is possible to adapt the use of the plates to the environment where the sound damping device is intended to be used, e.g. at high or low temperatures or in corrosive environments Preferably, said acoustic energy dissipative sheet material is micro-porous.

Suitably, said acoustic energy dissipative sheet material is provided with micro-perforations, such as micro-slits. It may alternatively be provided micro-cracks or circular holes.

Alternatively, said acoustic energy dissipative sheet material comprises sintered metal or sintered cemented carbide.

Preferably, the thickness of said acoustic energy dissipative sheet material is in the range $10^{-9}$ m-2 mm, more particularly $10^{-8}$ m-1 mm, even more particularly $10^{-7}$ m-0.9 mm.

Suitably, the air flow resistance of said acoustic energy dissipative sheet material is in the range 100-10 000 $Rayls_{MKS}$, more particularly in the range 200-1000 $Rayls_{MKS}$, even more particularly in the range 300-500 $Rayls_{MKS}$.

Alternatively, said acoustic energy dissipative sheet material comprises a membrane damping material in the form of a non-perforated sheet, the thickness of which is in the range 10 m-1 mm, more particularly $10^{-8}$ m-0.7 mm, even more particularly $10^{-7}$ m-0.5 mm.

DRAWING SUMMARY

In the following, the invention will be described in more detail with reference to the annexed drawings, in which FIG. 1A illustrates a sound damping device provided with a stack of rectangular elements forming flow channels in different directions;

DETAILED DESCRIPTION

Figure 1A:
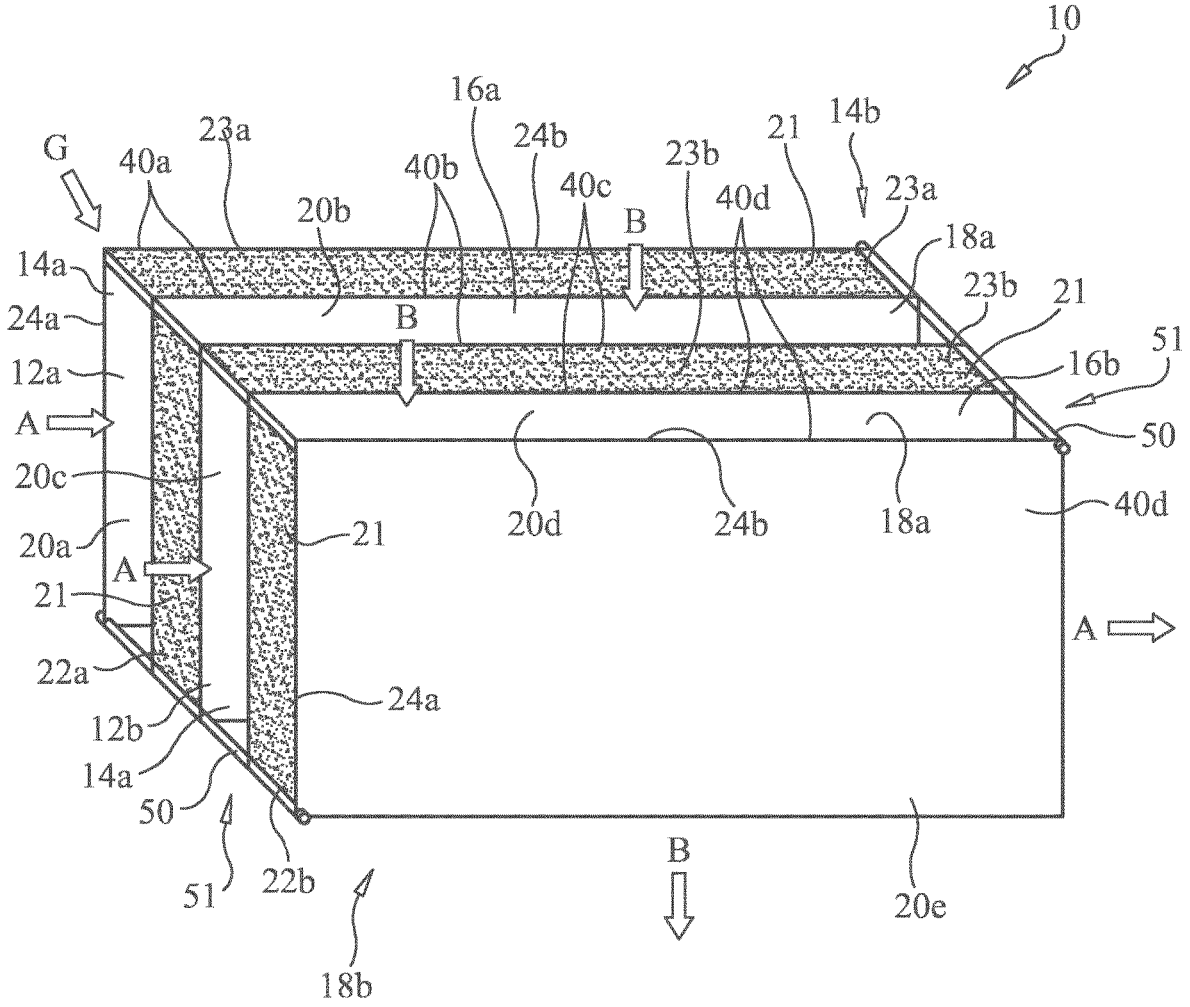
FIGS. 1B-1C illustrate alternative sound damping devices provided with a stack of square elements forming flow channels in different directions

FIG. 1A shows a sound damping device 10 for a flow inside a duct. The flow enters into the sound damping device in an inlet region 11*a* and exits in an outlet region 11*b*.

The sound damping device is in the inlet region 11*a* provided with a first channel 12*a* having a first channel inlet 13*a*; a second flow channel 16*a* having a second channel inlet 14*a*; a third flow channel 12*b* having an third channel inlet 15*a*; and a fourth flow channel 16*b* having a fourth channel inlet 17*a*.

Furthermore, in the outlet region 11*b* of the sound damping device, the first channel 12*a* has a first channel outlet 13*b*; the second flow channel 16*a* has a second channel outlet 14*b*; the third flow channel 12*b* has a third channel outlet 15*b*; and the fourth flow channel 16*b* has a fourth channel outlet 17*b*.

The first and third channels 12*a*, 12*b* are arranged above one another, The first, second, third and fourth channels 12*a*, 16*a*, 12*b*, 16*b* are arranged above one another. The second and fourth channels 16*a*, 16*b* are however turned perpendicularly to the first and third channels 12 *a*, 12*b*. The first and third channels 12*a*, 12*b* are parallel to one another. Likewise, the second and fourth channels 16*a*, 16*b* are parallel to one another.

The first, second, third and fourth channels 12*a*, 16*a*, 12*b*, 16*b* are defined by first, second, third, fourth and fifth rectangular walls 20*a*, 20*b*, 20*c*, 20*d*, 20*e* in the form of rectangular plates.

At the inlet region 11*a*, guide means 21 in the form of a first sealing means 22*a*, 22*b* is arranged at a first peripheral region 24*a* of every second pair of walls 20*b*, 20*c*; 20*d*, 20*e* leaving said first inlet opening 14*a* free and hereby defining said first and third channels 12*a* and 12*b* between every other second pair of walls 20*a*, 20*b*; 20*c*, 20*d* for a guiding first flow A.

Likewise, at the inlet region, guide means 21 second sealing means 23*a*, 23*b* is arranged at a second peripheral region 24*b* of every second pair of walls 20*a*, 20*b*; 20*c*, 20*d* leaving the second inlet opening 18*a* free and hereby defining said second and fourth channels 16*a* and 16*b* between every other second pair of walls 20*b*, 20*c*; 20*d*, 20*e* for a second flow B.

As can be understood from FIG. 1A, a general flow G directed towards all the first to fourth flow channels, will be divided by the first and third flow channels 12*a*, 12*b* and said second and fourth flow channels 16*a*, 16*b* into said first flow A and said second flow B.

As mentioned above, the walls 20*a*-20*e* are in the form of rectangular plates, and thus, said second peripheral region 24*b* is perpendicular to said first peripheral region 24*a*.

According to this embodiment, a first element 40*a* is constituted by the walls 20*a*, 20*b*, forming the first flow channel 12*a*, while a second element 40*b* is constituted by the wall 20*b* of the first element 40*a* and the neighbouring wall 20*c*, the walls 20*b*, 20*c* of the second element forming said second flow channel 16*a*.

Likewise, a third element 40*c* is constituted by the wall 20*c* of the second element 40*b* and the neighbouring wall 20*d*, forming the third flow channel 14*b*. In the same manner, a fourth element 40*d* is constituted by the wall 20*d* of the third element 40*c* and the neighbouring wall 20*e*, the walls of the fourth element 40*d* forming said fourth flow channel 16*b*.

The walls 20*a*-20*e* are at least partly made of a sound energy dissipative sheet material. Of course, one of the walls, a plurality of the walls or even all the walls may be made of said sound energy dissipative sheet material.

The plates are kept at a predetermined distance by means of a frame 51 comprising distance holder members 50 at each corner of the plates, hereby creating a constant cross-section of the flow channels 12*a*, 12*b*, 16*a*, 16*b*.

Alternatively, or in combination, said distance holding members 50 may be constituted by the guide means 21, i.e. the first and second sealing members 22*a*-22*b*, 23*a*-23*b*.

An end plate may be provided on top of the first element 40*a* in case further stability would be needed.

In order to further define the flow channels 12*a*, 16*a*, 12*b*, 16*b*, it is preferable, but not necessary, that guide means 21 is arranged in the outlet region 11*b* in a corresponding manner, i.e. opposite to that of first and second sealing members 22*a*-22*b*, 23*a*-23*b*. In this way, a straight flow A is created in the first and third channels 12*a*, 12*b*, and a straight flow B is created in the second and fourth channels 16*a*, 16*b*, flow A being perpendicular to flow B.

After having passed the sound damping device, flows A and B will mix inside the duct.

It should be noted that the sound damping device may comprise solely the elements 40*a*, 40*b* forming the first and second channels 12*a*, 12*b* arranged perpendicular to one another.

Figure 1B:
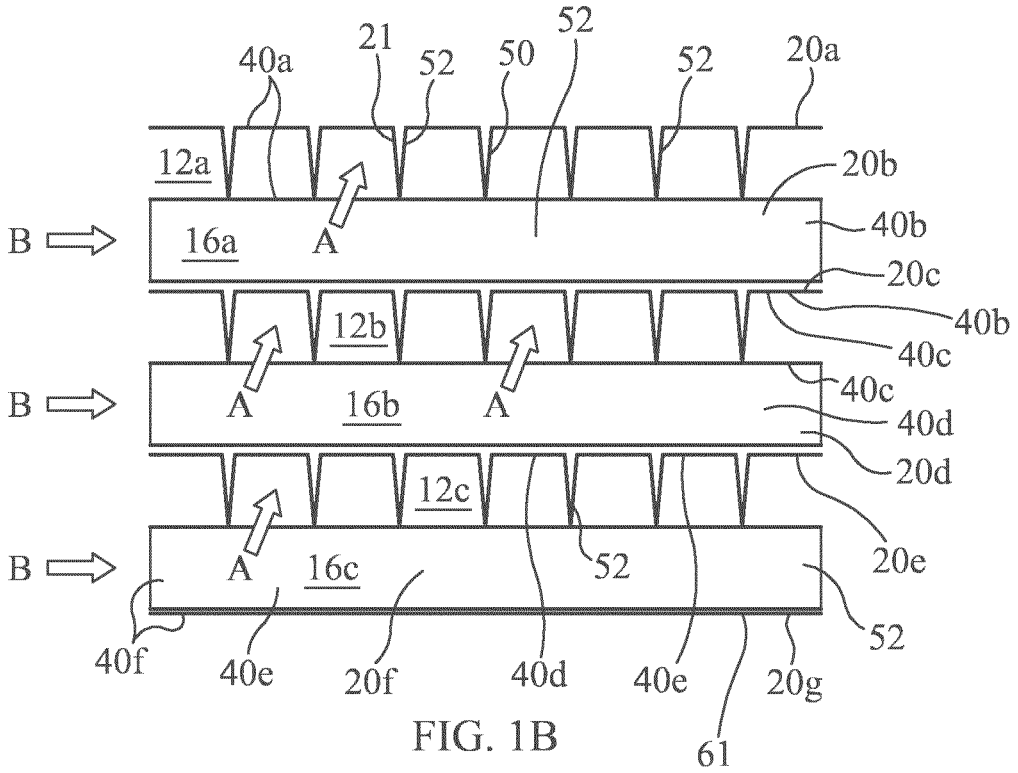

FIG. 1B shows another alternative, according to which the first, second, third, fourth, fifth and sixth walls 20*a*, 20*b*, 20*c*, 20*d*, 20*e*, 20*f* in the form of square plates are provided with guide means 21 in the form of elongated folds 52, also constituting integrated distance members 50. Wall 20*g* is an end plate 61 without folds. For better understanding of the FIG. 1B, a distance is shown between the walls 20*b*, 20*c*; 20*d*, 20*e*; and 20*f*, 20*g*, respectively.

Every second wall 20*a*, 20*c*, 20*e* is turned perpendicularly to every other second sheet 20*b*, 20*d*, 20*f*. Thus, the elongated folds 52 of the first wall 20*a* bear against the perpendicularly arranged second wall 20*b*, hereby forming a first flow channel 12*a* divided into parallel channels between the folds 52. Likewise, the elongated folds 52 of the second wall 20*b* bear against the perpendicularly arranged third wall 20*c*, hereby forming a second channel 16*a* divided into parallel channels between the folds 52.

It should be noted that in FIG. 1B, more or less only one of the elongated folds 52 can be seen of the second wall 20*b*, and in front of that particular fold 52, one of the second channels 16*a* is formed. This relates correspondingly to the fourth wall 20*d* and the sixth wall 20*f*.

In the same manner as described above, the elongated folds 52 of the third wall 20*c* bear against the perpendicularly arranged fourth wall 20*d*, hereby forming a third flow channel 12*b* divided into parallel channels between the folds 52. Likewise, the elongated folds 52 of the fourth wall 20*d* bear against the perpendicularly arranged fifth wall 20*e*, hereby forming a fourth flow channel 16*b* divided into parallel channels between the folds 52.

Furthermore, the elongated folds 52 of the fifth wall 20*e* bear against the perpendicularly arranged sixth wall 20*f*, hereby forming a fifth flow channel 12*c* divided into parallel channels between the folds 52. Likewise, the elongated folds 52 of the sixth wall 20*f* bear against a perpendicularly arranged seventh wall 20*g*, hereby forming a fourth flow channel 16*c* divided into parallel channels between the folds 52. Of course, also the seventh wall 20*g* may be shaped with folds 52 in order to form a further flow channel together with a further wall etc.

Each wall 20*a*-20*f* contacts a neighbouring wall provided with folds and turned perpendicularly thereto, hereby forming first, third and fifth flow channels 12*a*, 12*b*, 12*c* perpendicular to second, fourth and sixth flow channels 16*a*, 16*b*,16*c*.

Also in this case, the first element 40*a* is constituted by the first and second walls 20*a*, 20*b*, forming the first channel 12*a*; the second element 40*b* is constituted by the second wall 20*b* of the first element 40*a* and the neighbouring third wall 20*c*, the walls of the second element 40*b* forming said second channel 16*a*; the third element 40*c* is constituted by the third wall 20*c* of the second element 40*b* and the neighbouring fourth wall 20*d*, forming the third channel 12*b*; and the fourth element 40*d* is constituted by the fourth wall 20*d* of the third element 40*c* and the neighbouring fifth wall 20*e*, the walls of the fourth element 40*d* forming said fourth channel 16*b*.

Furthermore, a fifth element 40*e* is constituted by the fifth wall 20*e* of the fourth element 40*d* and the neighbouring sixth wall 20*f*, the walls of the fifth element 40*e* forming said fifth channel 12*c*.

A sixth element 40*f* is constituted by the sixth wall 20*f* of the fifth element 40*e* and the neighbouring seventh wall 20*g* (i.e. the end plate 61), the walls of the sixth element forming said sixth channel 16*c*.

It should be noted that the guide means 21 in the form of the elongated extension of the folds 52 connected to a neighbouring wall avoids the need for a sealing means dividing the flow G into flows A and B (cf. FIG. 1A). For the same reason, a frame is not needed, since the stack of walls is self-supporting. Furthermore, in case the folds comprise an acoustic energy dissipative material, this will add to the sound damping effect, since the sound waves will hit the acoustic energy dissipative material more often than what is the case in the embodiment shown in FIG. 1A.

Figure 1C:
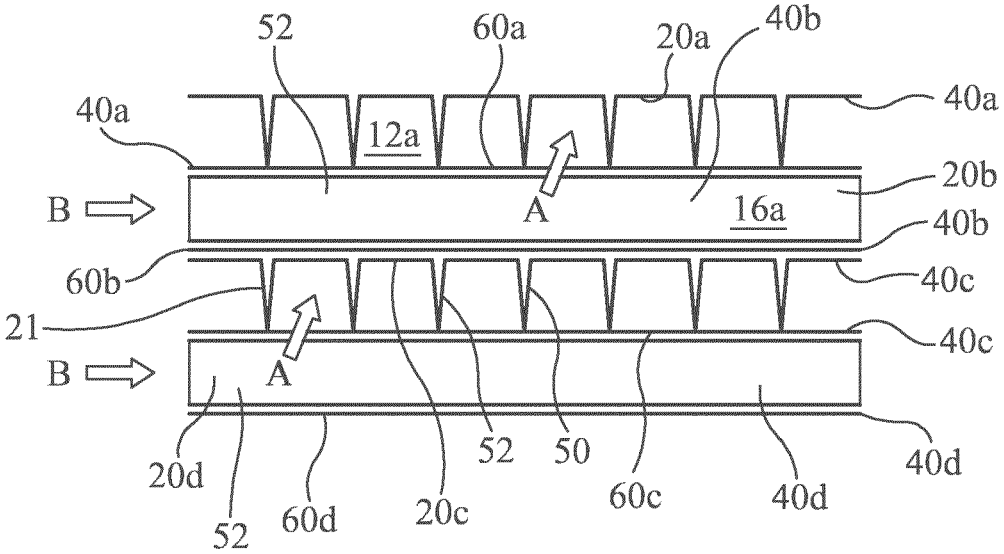

According to an alternative embodiment, and as shown in FIG. 1C, the first element 40*a* is constituted by the first wall 20*a* provided with guide means in the form of distance holding means 50 in the form of folds 52 in the manner corresponding to what is described in connection with FIG. 1B, but resting against a first intermediate wall 60*a*. Thus, a number of parallel first channels 12*a* are formed between each fold 52 and the first intermediate wall 60*a*.

Likewise, the second element 40*b* is constituted by the second wall 20*b* provided with folds 52 resting against a second intermediate wall 60*b*, such that a number of parallel channels 16*a* are formed between each fold 52 and the second intermediate wall 60*b*.

Again, the third element 40*c* is constituted by the third wall 20*c* provided with folds 52 resting against a third intermediate wall 60*c*, such that a number of parallel channels 14*b* are formed between each fold 52 and the third intermediate wall 60*c*.

Likewise, the fourth element 40*d* is constituted by the fourth wall 20*d* provided with folds 52 resting against a fourth intermediate wall 60*d*, such that a number of parallel channels 16*b* are formed between each fold 52 and the fourth intermediate wall 60*d*.

In order to create perpendicularly arranged channels, the first element 40*a* is turned perpendicularly to the second element 40*b*, while the second element 40*c* is turned perpendicularly to the third element 40*d* etc.

Of course, in the embodiments of FIGS. 1B and 1C, further or less elements may be provided in order to create further or less channels. In particular, the stack of elements may comprise solely the elements 40*a*, 40*b* forming the first and second perpendicular channels 12*a*, 12*b*.

Also in this case, the elongation of the folds 52 avoids the need for sealing members for dividing the flow G into A and B (cf. FIG. 1A). Unless the elements 40*a*-40*d* are welded or glued together, a frame may be needed in order to keep the elements 40*a*-40*d* together.

On the other hand, in the embodiments of FIGS. 1B and 1C, a sealing member may of course be arranged in the inlet region 11*a* at the edge of every second pair of walls in a manner corresponding to that of what shown in FIG. 1A, and optionally in the outlet region 11*b* for creating flow channels 12*a*, 12*b* and 12*c* for flow A and flow channels 16*a*, 16*b* and 16*c* for flow B.

In the embodiment of FIG. 1C, not only the walls 20*a*-20*d* are at least partly made of a sound energy dissipative sheet material, but any one, a plurality or all of the first to fourth intermediate walls 60*a*-60*d* may be partly or completely made of such material.

An end plate may be provided on top of the first element 40*a* in order to add to the stability.

It should be noted that the elements 40*a*-40*d* of FIG. 1A may also be constituted by a pair of walls as shown in FIG. 1C, however without folds.

Figure 2:
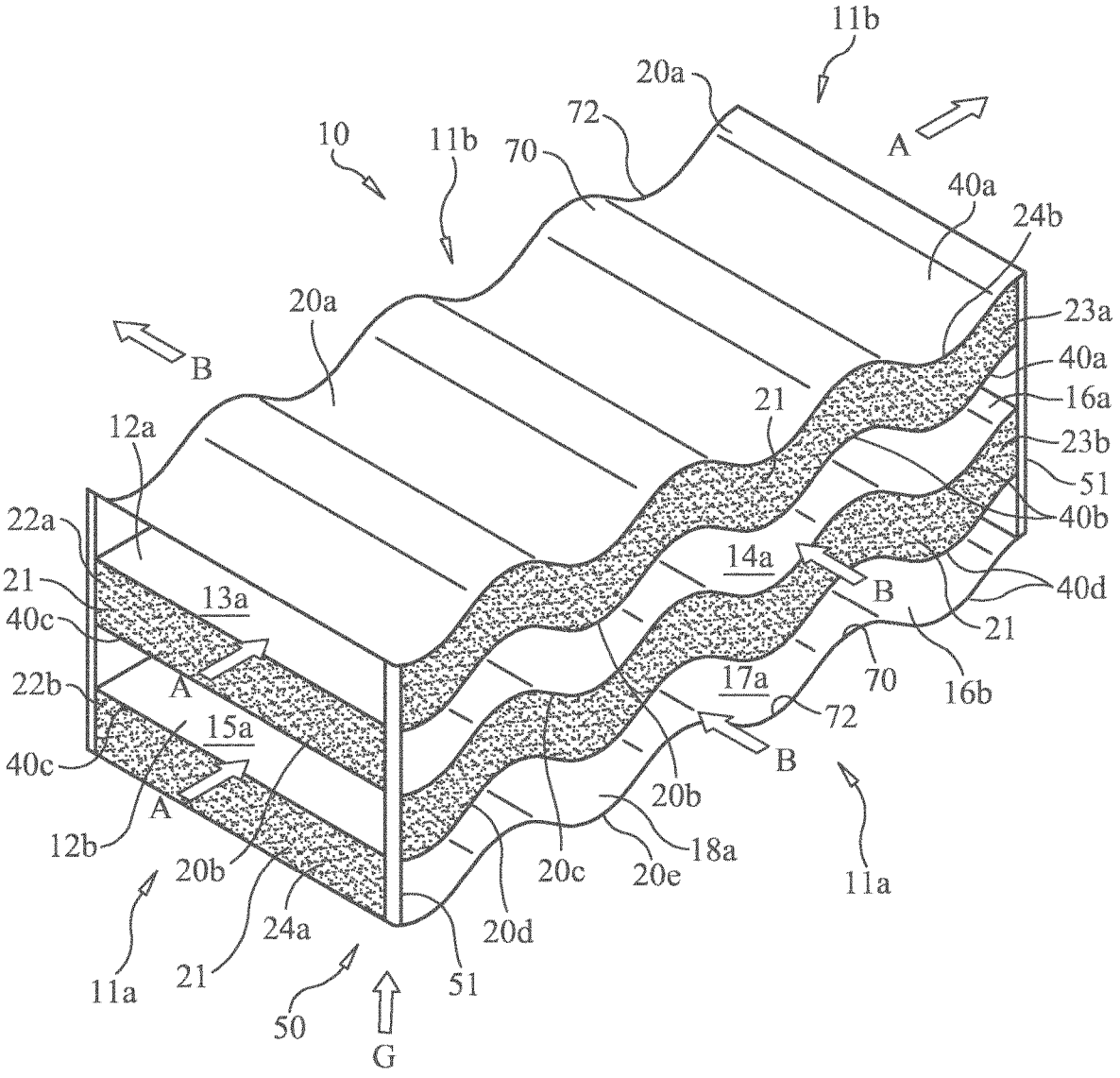
FIG. 2 illustrates an alternative stack of elements comprising rectangular corrugated plates in a parallel relationship.

FIG. 2 shows an alternative embodiment, according to which the sound damping device 10 comprises walls 20*a*-20*e* in the form of rectangular corrugated plates with ridges 70 and valleys 72. The ridges 70 and valleys 72 of the corrugations are arranged in the same vertical plane by means of a frame 51 comprising distance holding members 50, hereby creating a constant cross-section of the flow channels 12*a*, 12*b*, 16*a* and 16*b*, respectively.

In order to divide the flow G into a flow A and a flow B, the walls 20*a*, 20*b*, constituting the first element are provided with guide means 21 in the form of a first sealing member 22*a* at first peripheral region 24*a*. The walls 20*b*, 20*c*, constituting the second element 40*b* are provided with guide means 21 in the form of a second sealing member 23*a*, at second peripheral region 24*b*. The walls 20*c*, 20*d*, constituting the third element 40*c*, are provided with guide means 21 in the form of a third sealing member 22*b* at the first peripheral region 24*a*. Likewise, the walls 20*d*, 20*e*, together constituting the fourth element 40*d*, are provided with guide means 21 in the form of a fourth sealing member 23*b* at the peripheral region 24*b*.

The flow A will be forced up the ridges 70 and down the valleys 72, while the flow B will be substantially straight.

In the embodiment of FIG. 2, at least every second of the walls 20*a*-20*e*, but preferably each wall is at least partly made of a sound energy dissipative sheet material. However, all of the walls 20*a*-20*e* may at least partly be made of a sound energy dissipative sheet material. Of course, the walls 20*a*-20*e* may be completely made of a sound energy dissipative sheet material.

Of course, an end plate may be provided on top of the first element 40*a* and under the third element 40*c* in order to add to the stability.

Figure 3A:
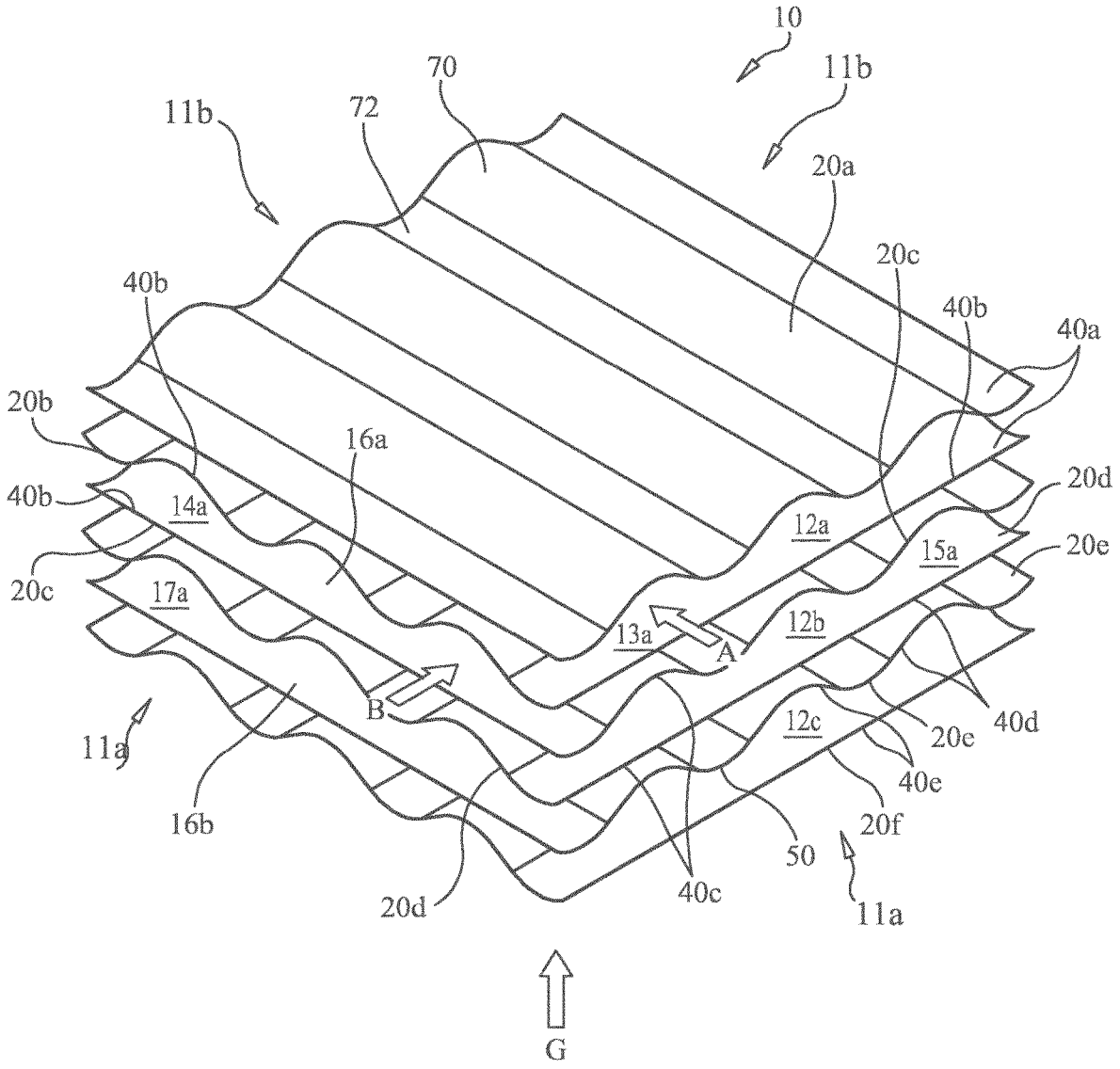
FIGS. 3A and 3B are exploded views of alternative stacks of elements comprising square corrugated plates arranged in a cross-wise relationship.

FIG. 3A shows in a manner corresponding to that of FIG. 1B the sound damping device 10, including walls 20*a*-20*f*, however in the form of corrugated plates, having a substantially square shape after corrugation. However, according to this embodiment, the walls 20*a*-20*f* are arranged such that the ridges 70 and valleys 72 of neighbouring sheets are substantially in a perpendicular relationship and are resting against one another, such that the ridges 70 and valleys 72 constitute distance holding members 50 in relation to the neighbouring wall 20*a*-20*f* (for better understanding of the FIG. 3A, the walls are shown somewhat separated from one another). The walls 20*a*-20*f* thus form a stack of substantially square corrugated plates, each having an end region 24*a*, 24*b* perpendicular to one another.

The square corrugated walls 20*a*-20*f* may be glued or welded together at regions or points where they rest against one another. The walls 20*a*-20*f* may also be kept as a stack by a frame, but in case they are glued or welded together, the stack is self supporting without need for a frame. By gluing or welding the ridges 70 and valleys 72 towards one another, guide means is formed for the respective channels.

The first element 40*a* is constituted by the first and second walls 20*a*, 20*b*. The second element 40*b* is constituted by the second and third walls 20*b*, 20*c*. Likewise, the third element 40*c* is constituted by the third and fourth walls 20*c*, 20*d*. Furthermore, the fourth element 40*d* is constituted by the fourth and fifth walls 20*d*, 20*e*. Yet furthermore, the fifth element 40*e* is constituted by the fifth and sixth walls 20*e*, 20*f*.

The first, third and fifth flow channels 12*a*, 12*b*, 12*c* are created by arranging a guide means 21 in the form of a sealing (not shown) at the end region 24*a* of and between every second wall 20*b*, 20*c*; 20*d*, 20*e* of the stack. The second and fourth flow channels 16*a*, 16*b* are created by arranging a sealing (not shown) at the perpendicular end region 24*b* and between every other second wall 20*a*, 20*b*; 20*c*, 20*d*; 20*e*, 20*f* of the stack. The sealing members have been omitted for better understanding of the figure.

Consequently, the first, third and fifth flow channels 12*a*, 12*b*, 12*c* are perpendicular to the second and fourth channels 16*a*, 16*b*.

Optionally, guide means 21 in the form of sealing members may be arranged in the outlet region 11*b* in a corresponding manner, i.e. opposite to the sealing members at the inlet region, for creating a substantially straight flow (i.e. apart from corrugations) through the perpendicular channels of the stack.

In case an end wall is added on top of wall 20*a*, an additional flow channel them between would be formed them between. Likewise, in case an end wall is provided underneath the sixth wall 20*f*, an additional sixth flow channel would be formed them between. On the other hand, it would of course be possible to add further corrugated plates and arrange them in the stack in the manner described.

Figure 3B:
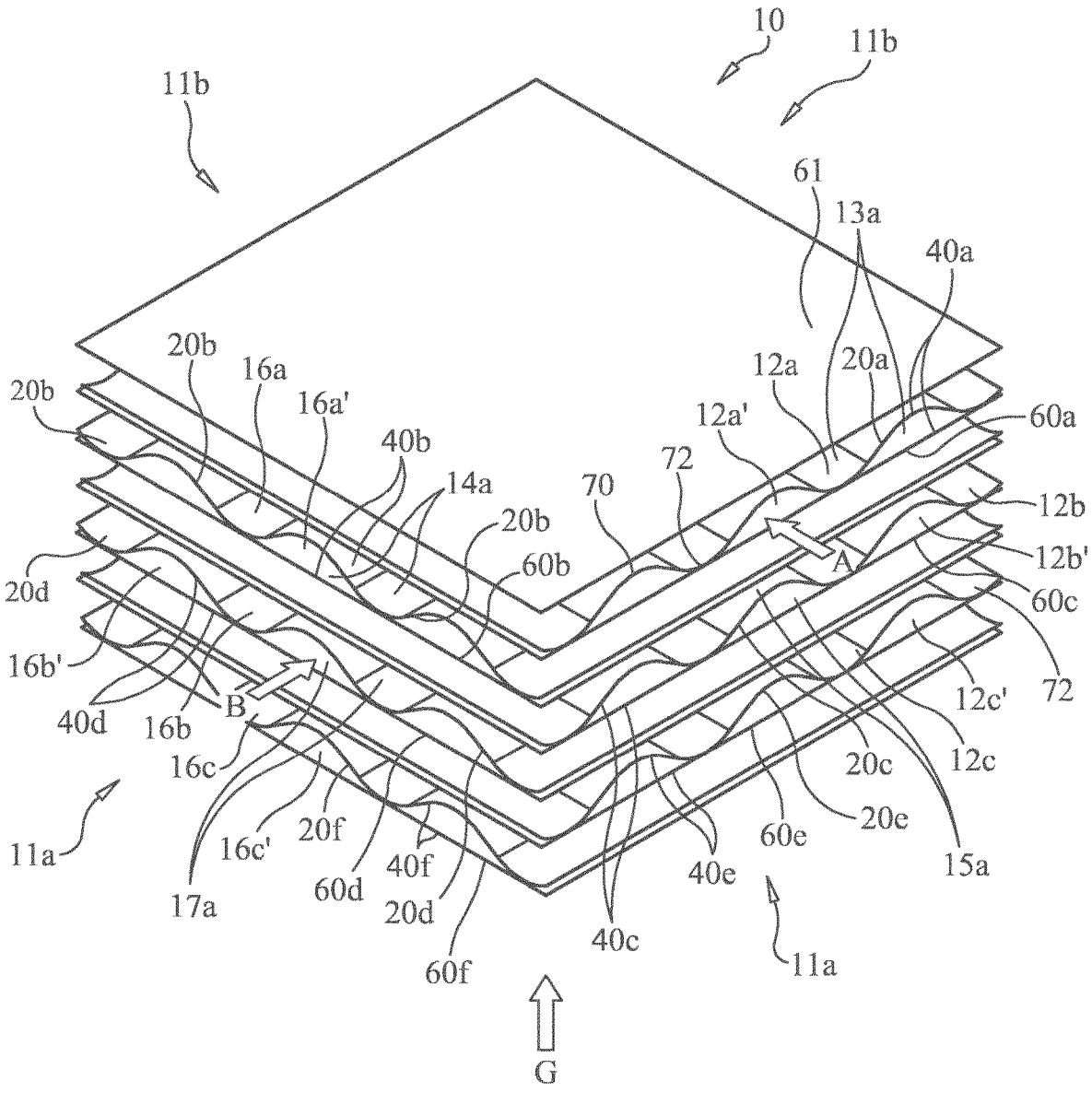

Alternatively, as shown in FIG. 3B, underneath the end plate 61, the first element 40*a* comprises the corrugated first wall 20*a* and a first intermediate wall 60*a*, in a manner corresponding to that of FIG. 1C. Distance holding members 50 towards the end plate 61 are provided in the form of the ridges 70 of the corrugated wall 20*a*, the ridges 70 of which being adapted to rest against the end plate 61, such that a plurality of first channels 12*a* are formed between each ridge 70 and the end plate 61 (for better understanding of the FIG. 3B, the walls are shown somewhat separated from one another).

On the opposite side of the first wall 20*a*, the valleys 72 rest against a first intermediate wall 60*a*, together forming a first element 40. A plurality of additional first channels 12*a*' are formed between each valley 72 and the first intermediate wall 60*a*.

The end plate 61 thus forms together with the first wall 20*a* the first channel 12*a*, while the first element 40*a* as such forms an additional first channel 12*a*', parallel the first channel 12*a*, both intended for the first flow A.

In a corresponding manner, the second element 40*b* comprises the second wall 20*b* and the second intermediate wall 60*b*, a third intermediate wall 60*c* and the second corrugated wall 20*b* arranged between the second and third intermediate walls 60*b*, 60*c*. The ridges 70 of the second corrugated wall 20*b* constitutes distance holding means 50 in relation to the second intermediate wall 60*b*, such that a plurality of second channels 16*a* are formed between the ridges 70 and the second intermediate wall 60*b*.

Likewise, the valleys 72 of the second corrugated wall 20*b* constitute distance holding means 50 in relation to the third intermediate wall 60*c*, such that a plurality of additional second channels 16*a*' are formed between the ridges 70 and the second intermediate wall 60*b*, the second channels 16*a* and the additional second channels 16*a*' being in a parallel relationship and constituting channels for the second flow B.

The second corrugated wall 20*b* of the second element 40*b* is arranged perpendicularly to the first corrugated wall 20*a* of the first element 40*a*.

The third element 40*c* comprises the third intermediate wall 60*c*, a fourth intermediate wall 60*d* and a third corrugated wall 20*c*, arranged between the third and fourth intermediate walls 60*c*, 60*d*. The ridges 70 of the third corrugated wall 20*c* constitutes distance holding means 50 in relation to the third intermediate wall 60*c*, such that a plurality of third channels 12*b* are formed between the ridges 70 and the third intermediate wall 60*c*. Likewise, the valleys 72 of the third corrugated wall 20*c* constitutes distance holding members 50 in relation to the fourth intermediate wall 60*d*, such that a plurality of additional third channels 12*b*' are formed between the valleys 72 and the fourth intermediate wall 60*d*. The third channels 12*b* and the additional third channels 12*b*' are in a substantial parallel relationship and constitute channels for the first flow A.

The third corrugated wall 20*c* of the third element 40*c* is arranged perpendicularly to the second corrugated wall 20*b* of the second element 40*b*.

The fourth element 40*d* comprises the fourth intermediate wall 60*d*, a fifth intermediate wall 60*e* and a fourth corrugated wall 20*d*, arranged between the fourth and fifth intermediate walls 60*d*, 60*e*. The ridges 70 of the fourth corrugated wall 20*d* constitutes distance holding means 50 in relation to the fourth intermediate wall 60*d*, such that a plurality of fourth channels 16*b* are formed between the ridges 70 and the fourth intermediate wall 60*d*. Likewise, the valleys 72 of the fourth corrugated wall 20*d* constitutes distance holding means 50 in relation to the fifth intermediate wall 60*e*, such that a plurality of additional fourth channels 16*b*' are formed between the valleys 72 and the fifth intermediate wall 60*e*. The fourth channels 16*b* and the additional fourth channels 16*b*' are in a parallel relationship and constitute channels for the second flow B.

The fourth corrugated wall 20*d* of the fourth element 40*d* is arranged perpendicularly to the third corrugated wall 20*c* of the third element 40*c*.

The fifth element 40*e* comprises the fifth intermediate wall 60*e*, a sixth intermediate wall 60*f* and a fifth corrugated wall 20*e*, arranged between the fourth and fifth intermediate walls 60*e*, 60*f*. The fifth intermediate wall 60*e* and the fifth corrugated wall 20*e* together form a fifth channel 12*c*, and the sixth intermediate wall 60*f* and the fifth corrugated wall 20*e* together form an additional fifth channel 12*c*' in a manner corresponding to that of the first and the third elements 40*a*, 40*c*. Thus, the fifth channel 12*c* and the additional fifth channel 12*c*' are parallel to one another.

Furthermore, the fifth corrugated wall 20*e* of the fifth element 40*e* is arranged perpendicularly to the fourth corrugated wall 20*d* of the fourth element 40*d*.

The fifth channel 12*c* and the additional fifth channels 16*c*' are in a parallel relationship and constitute channels for the second flow A.

Consequently, the flow channels and additional flow channels 12*a*, 12*a*', 12*b*, 12*b*', 12*c*, 12*c*' of the first, third and fifth elements 40*a*, 40*c*, 40*e* are parallel to one another and perpendicular to the flow channels and additional flow channels 16*a*, 16*a*', 16*b*, 16*b*' of the second and fourth elements 40*b*, 40*d* in order to divide the flow G in a first flow A and a second flow B, substantially perpendicular to one another through the sound damping device 10.

By this configuration, the cross-section of all channels 12*a*, 12*b*, 16*a* and 16*b* will be substantially constant and have substantially the same cross-sectional dimensions.

Also in this case, the elongation of the ridges 70 and the valleys 72 avoids the need for a distance holding members in the form of sealing members for dividing the flow G into first flow A and second flow B. Thus, as shown in FIG. 3A, the flow G will be divided into flows A and B without need for a distance holding member in the form of a frame in the corner of the plates.

It would of course be possible to add guide means 21 in the form of sealing members between every second element of the stack in a manner corresponding to what is described in connection with FIG. 3A.

Again, the walls 20*a*-20*f* and the intermediate walls 60*a*-60*f* may be kept together as a stack by a frame 51. Hereby, mounting as a single unit in a duct or a chamber is facilitated.

Figure 4:
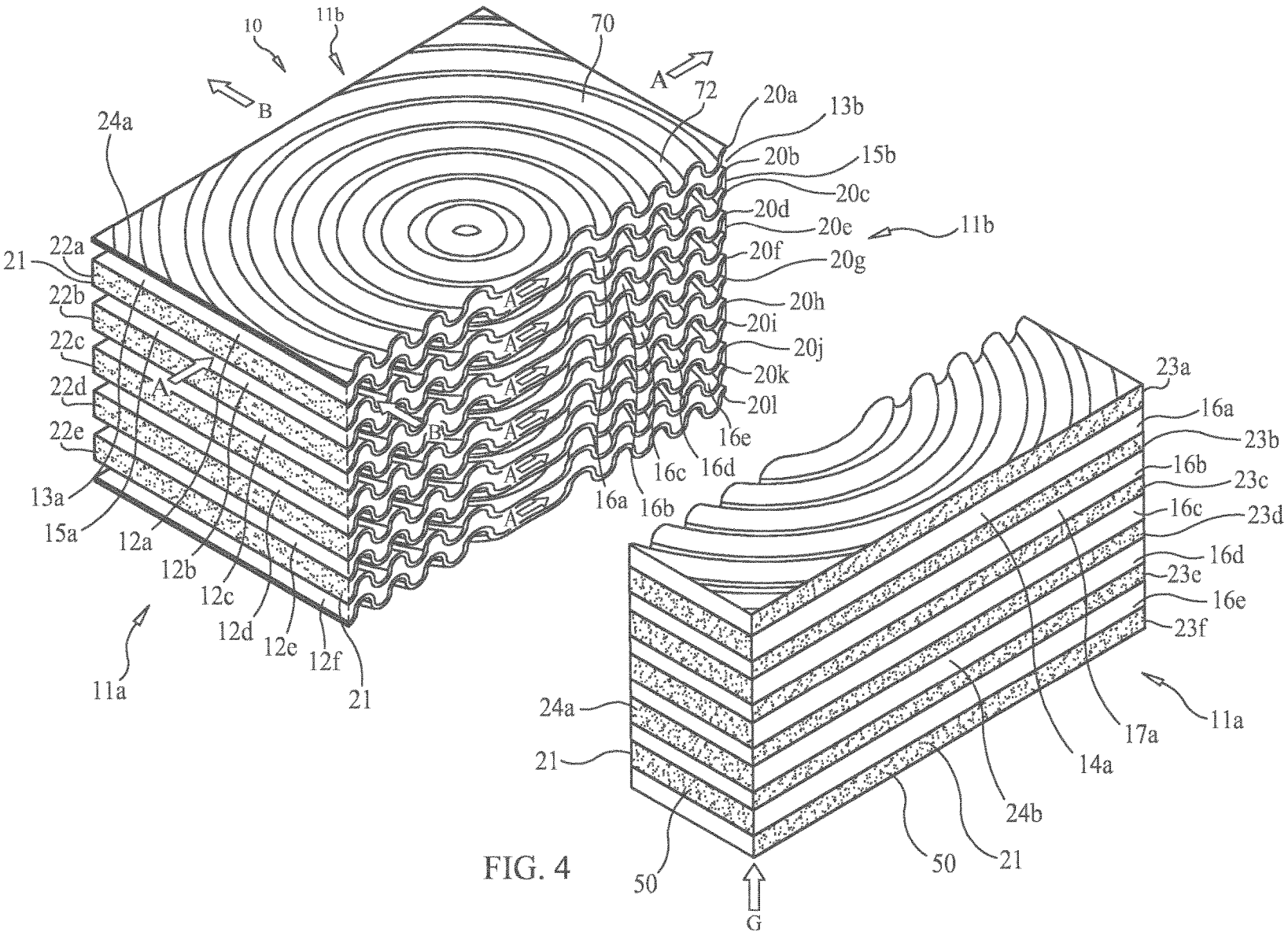
FIG. 4 illustrates an alternative stack of elements comprising square plates having annularly shaped grooves and ridges.

FIG. 4 shows a stack of substantially square walls 20*a*, 20*b*, 20*c*, 20*d*, 20*e*, 20*f*, 20*g*, 20*h*, 20*i*, 20*j*, 20*k*, 20*l* in the form of plates provided with annularly shaped ridges 70 and valleys 72. A portion of the stack has been cut off for improving understanding of the figure.

Guide means 21 in the form of sealing members 22*a*-22*e* are provided in the peripheral region 24*a* and between every second wall at the inlet region 11*a* and the outlet region 11*b* of the sound damping element. Furthermore, sealing members 23*a*-23*f* are provided in the perpendicular peripheral region 24*b* and between every other second wall at the inlet and outlet regions 11*a*, 11*b*.

Hereby, distance holding means 50 is provided for keeping the stack of walls 20*a*-201 at a desired distance from one another, in order to divide the general flow G into a first flow A in flow channels 12*a*-12*f* and a second flow B in flow channels 16*a*-16*e*.

Preferably, but not necessarily, the size of the sealing members 22*a*-22*e* and 23*a*-23*f* are chosen such that a constant cross-section of the flow channels 12*a*-12*f* and 16*a*-16*e* is achieved.

Even though the size of the sealing members 22*a*-22*e* may be the same as the size of the sealing members 23*a*-23*f*, it is contemplated that the size of the sealing members 22*a*-22*f* may be different from the size of the sealing members 23*a*-23*f*.

Figure 5:
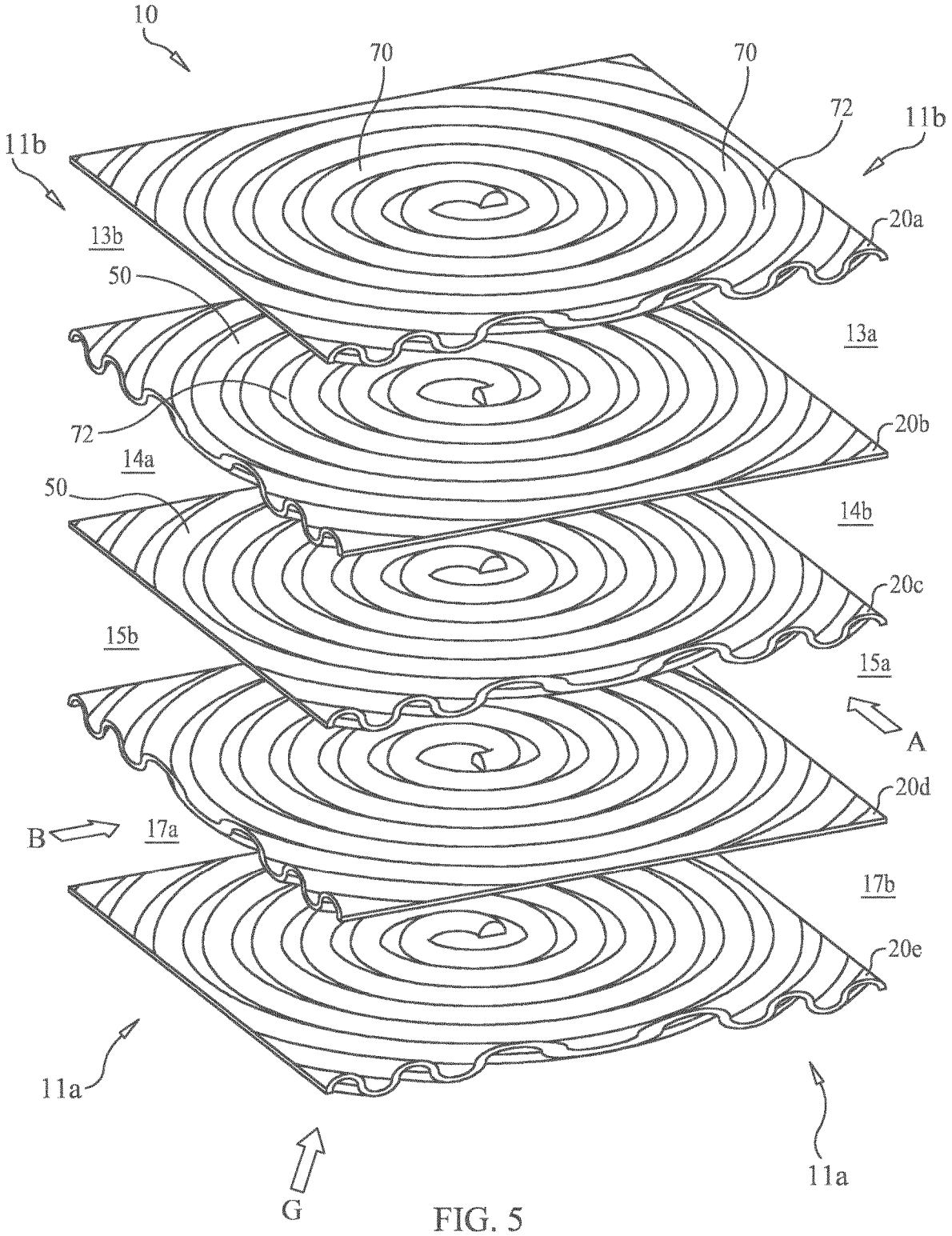
FIG. 5 is an exploded view of an alternative stack of elements comprising square plates having spirally shaped grooves and ridges.

FIG. 5 shows in an exploded view a stack of walls 20*a*-20*e* in the form of plates provided with a spirally shaped ridge 70 and a spirally shaped valley 72. By turning the sheets at an angle, preferably perpendicularly or 180° to one another, the ridge 70 and the valley 72 of neighbouring sheets will constitute distance holding means 50. The stack of walls may be glued or welded together at contact areas between the ridges 70 and the valleys, or just rest towards one another.

It would of course be possible to arrange the corrugated plates in a stack of walls at a distance from one another by means of a suitable distance holding means (cf. FIG. 4), instead of gluing of welding them together.

Disregarding whether the walls of the stack are glued together, guide means are provided for keeping the walls at a distance from one another and for separating the flow G in flows A and B in a manner corresponding to that described in connection with FIG. 4. Thus, guide means in the form of sealing members (omitted form the figure for facilitating understanding thereof) are provided in the peripheral region and between every second wall at the inlet region 11*a* and the outlet region 11*b* of the sound damping element. Furthermore, guide means sealing members are provided in the perpendicular peripheral region and between every other second wall at the inlet and outlet regions 11*a*, 11*b*.

The result is also in this case a substantially straight flow path, for creating a substantially straight flow (apart from what is caused by the spiral ridges and valleys) through the mutually perpendicular channels of the stack, It would also be possible to provide the walls with two or more parallel spirals of ridges and valleys. It would furthermore be possible to turn every second wall upside down instead of turning them 90° or 180°.

Figure 6:
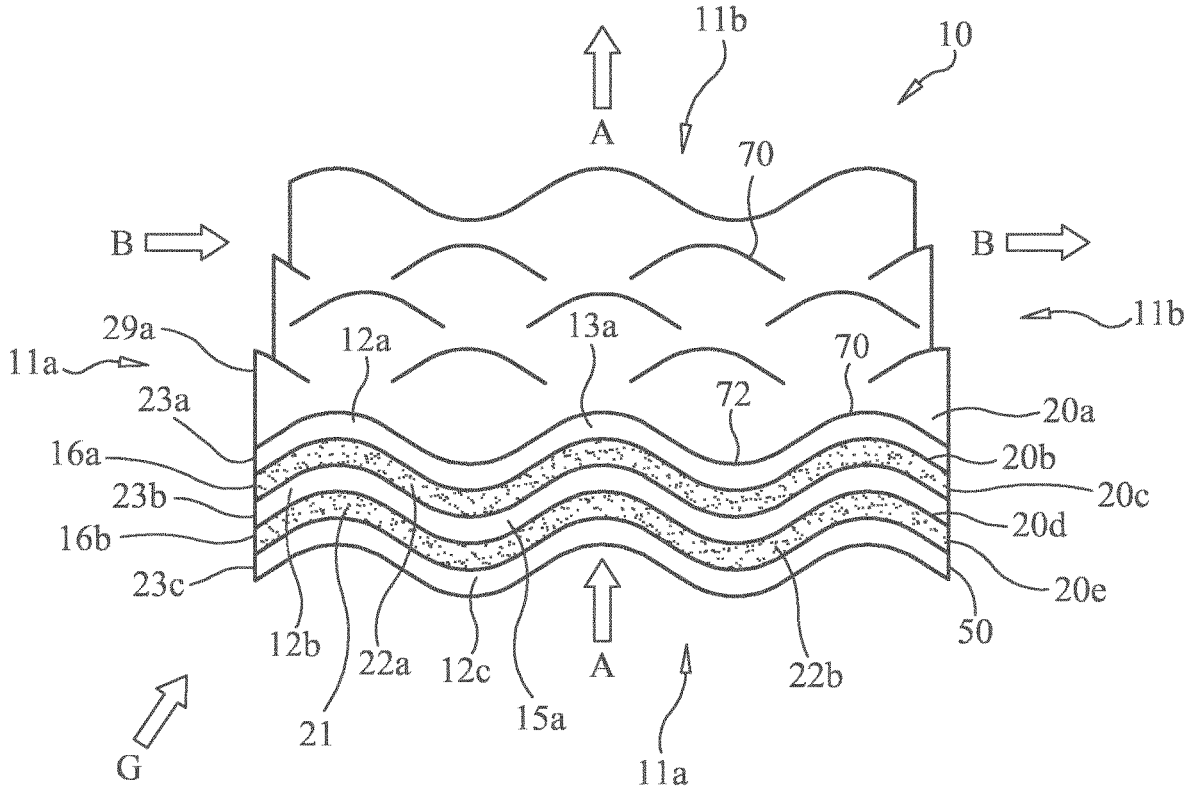
FIG. 6 illustrates an alternative stack of elements comprising square plates with bumps and indentations.

FIG. 6 shows a stack of walls 20*a*-20*e* in the form of square plates provided with protrusions in the form of positive bumps 70' surrounded by similarly shaped indentations in the form of negative bumps 72' in the opposite direction.

First sealing members 22*a*, 22*b* are arranged between every second wall at regions 24*a* on one side, while second sealing means are provided between every other second wall at perpendicular region 24*b* for dividing a flow G in a first flow A in channels 12*a*-12*c* and a second flow B in flow channels 16*a*, 16*b*, 16*c*.

Combined guide means 21 and distance holding means 50, in the form of sealing members 22*a*-22*c* and 23*a*-23*b* are shaped in such a way that positive bumps 70' of neighbouring walls are placed above one another and negative bumps 72' are placed above one another in order to achieve flow channels 12*a*-12*c* preferably of the same cross-section, and flow channels 16, 16*b* of the same cross-section. In addition, or alternatively, a frame may be used for achieving a desired cross-section of the mutually perpendicular flow channels and/or for facilitating mounting in a duct or chamber.

Figure 7:
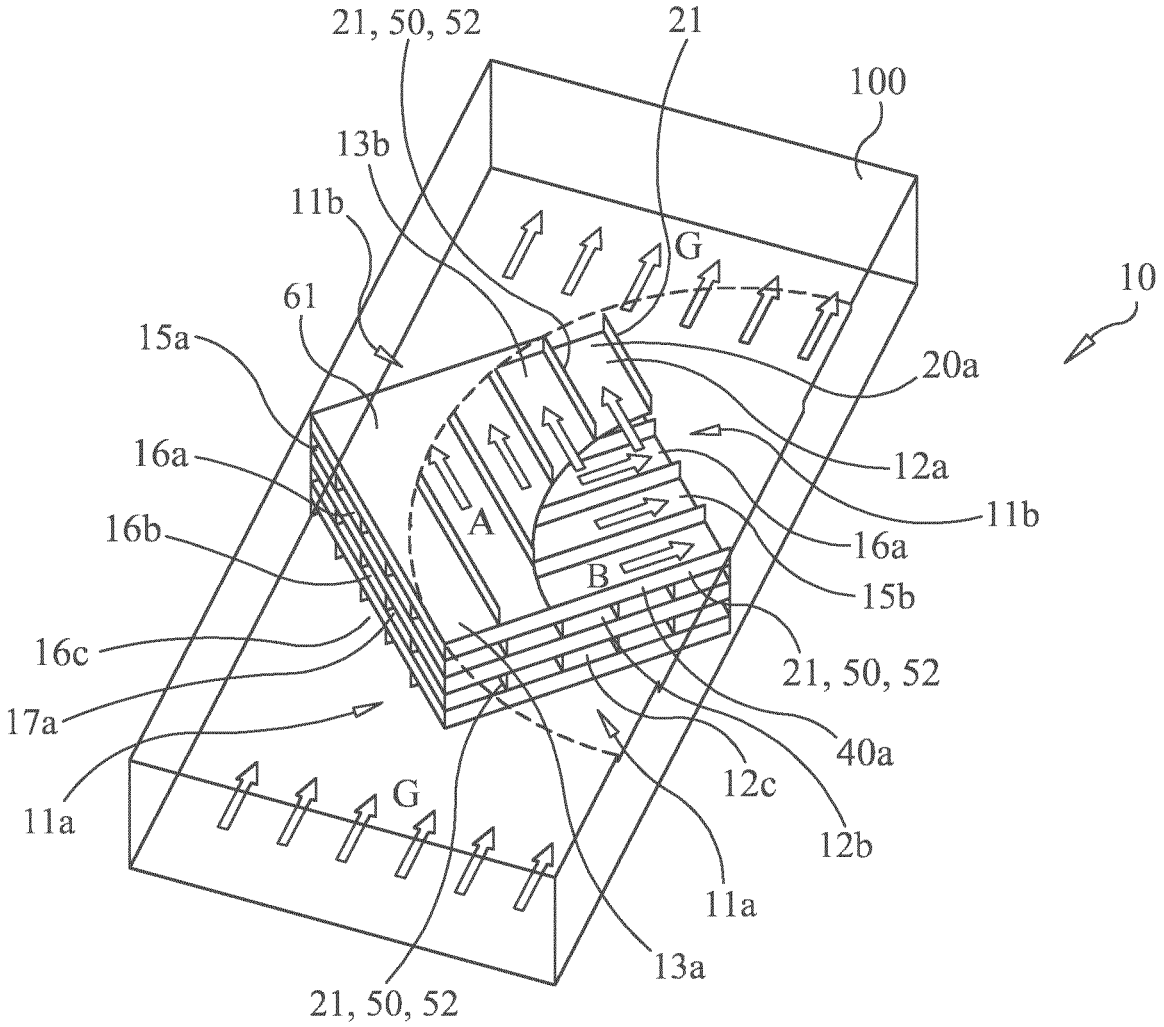
FIG. 7 illustrates the sound damping device of FIG. 1B arranged in a rectangular duct.

FIG. 7 shows the sound damping device 10 of the kind shown and explained in connection with FIG. 1B, arranged in a duct 100 having rectangular cross-section. The sound damping device is provided with square walls (see 20*a*-20*f* in FIG. 1B) and an end plate 61 in such a way that the flow cannels 12*a*, 12*b*, 12*c* and the flow channels 16*a*, 16*b*, 16*c* divide the general flow G into first flow A and second flow B. In order to achieve this, the corner of the stack of plates, or in other words, the diagonal of the stack of plates is directed towards the flow direction G.

After the sound damping device, in the direction of flow of the duct 10, the flows A and B will again mix to a general flow G. An additional end plate may be provided in the bottom of the stack, i.e. below channel 16*c*. As already explained in connection with FIG. 1B, the guide means 21 in the form of elongated folds 52 not only constitute distance holding means 50, but also sealing members; if needed, the folds are welded or glued towards the neighbouring wall.

It should be noted that instead of the sound damping device shown in FIG. 7, the sound damping device of the kind shown and explained in connection with FIG. 1C, i.e. comprising intermediate walls, may be used inside the duct 100.

It is contemplated that in case a square shape of the walls is chosen, the sound damping device of any one of the embodiments shown and discussed in connection with FIGS. 2, 3A, 3B, 4, 5 and 6 may be used inside the duct 100.

It should furthermore be noted that the diagonal of the stack may be directed offset to the flow direction. This is in particular the case where the sound damping device in mounted inside the duct right before a duct bend.

The cross-section of the duct may of course be square rather than rectangular.

Figure 8A:
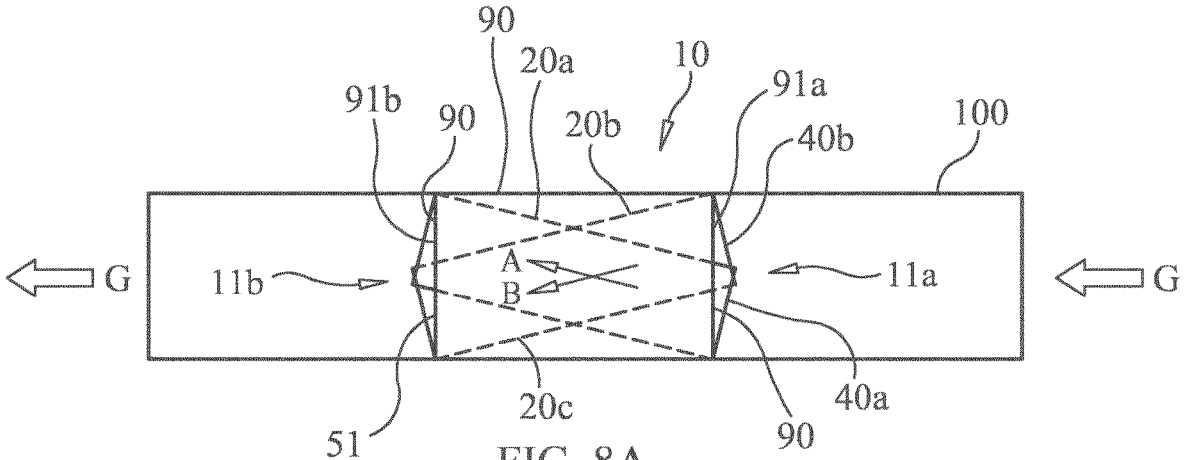
FIG. 8A illustrates a sound damping device provided with a stack of crossed rectangular plates arranged as a tubular unit inside a tubular duct.

FIG. 8A shows a circular cylindrical duct 100 provided with a sound damping device 10 comprising a frame 51 in the form of a circular cylindrical housing 90 and rectangular elements 40 or walls 20 as shown in etc. arranged at an angle relative to one another in the range 10°-150°, more particular 30°-140°, even more particular 40°-100°, most particular 60°-94°.

The circular cylindrical housing 90 has open ends 91*a*, 91*b* parallel to one another and across an axis through its elongation. Thus, the edges of elements 40 or walls 20 extend through the open ends 91*a*, 91*b* of the cylinder. Of course, the width of the walls becomes narrower in a direction across the walls due to the cylindrical shape of the housing 90.

Figure 8B:
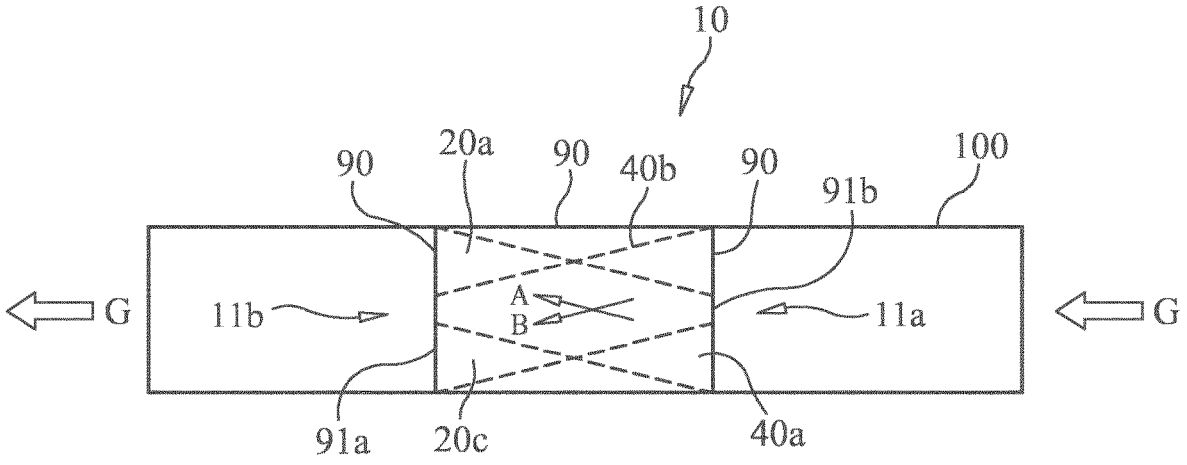
FIG. 8B illustrates a variant of the unit shown in FIG. 8A.
Figure 8C:
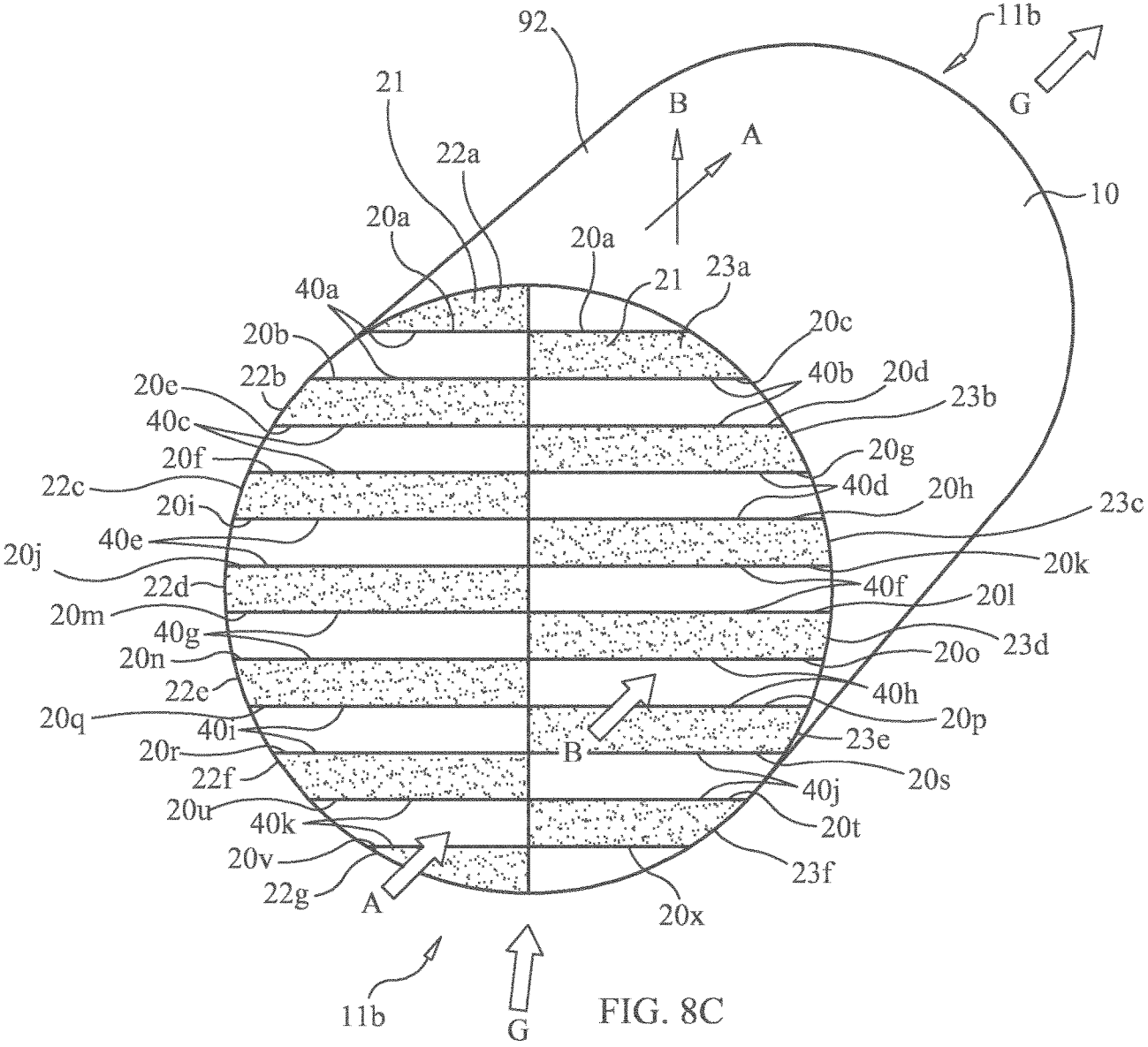
FIG. 8C is a perspective view of the unit shown in FIG. 8B.

As shown in FIGS. 8B and 8C, easy installation into a circular cylindrical duct 100 is made by cutting the edges the rectangular elements 40 or walls 20 in order to conform to the open ends 91*a*, 91*b* of the circular cylindrical housing 90. Thus, the walls 20 etc. will after cutting be in the form of a non-perpendicularly angled parallelogram, i.e. in case the sides are of equal length, each wall would have the shape of a rhombus.

The sound damping device 10 is thus formed as a circular cylindrical unit 92, provided with elements 40*a*-40*k* including walls 20*a*-20*x* and furthermore guide means 21 in the form of sealing members 22*a*-22*g*; 23*a*-23*f*.

The first sealing members 22*a*, 22*b* etc. and the second sealing members 23*a*, 23*b* etc. allow the flow G to be divided in a cross-wise manner inside the cylinder. Due to the circular cross-section of unit 92, the width of the rhombus 20*e* is broader than the width of the rhombus 20*a* and 20

It would of course be possible to arrange a sound damping device provided with rectangular elements or walls inside a duct having a rectangular (see FIG. 7) or square cross-section.

Figure 9:
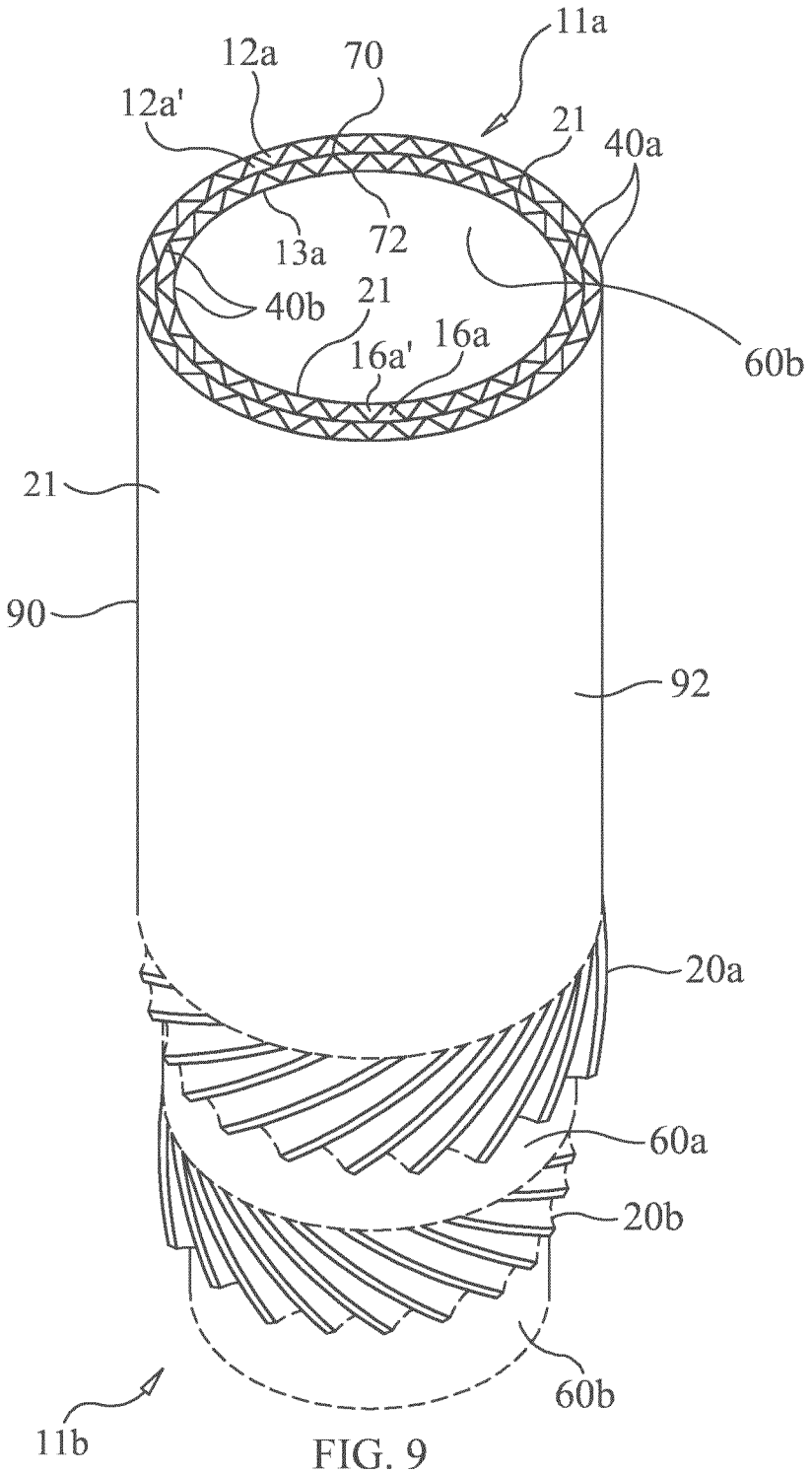
FIG. 9 illustrates a tubular sound damping device provided with tubular elements with portions partly broken away.
Figure 10A:
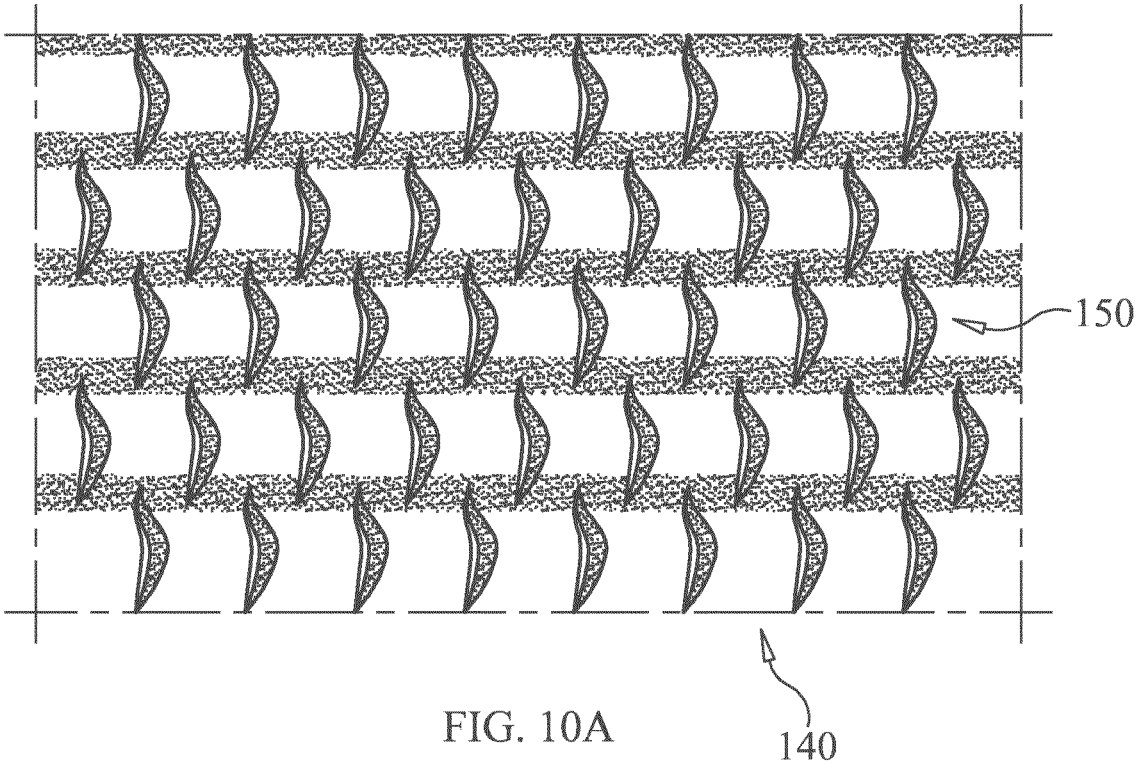
FIG. 10A-10C illustrate a micro-slit sound energy dissipative material.
Figure 10B:
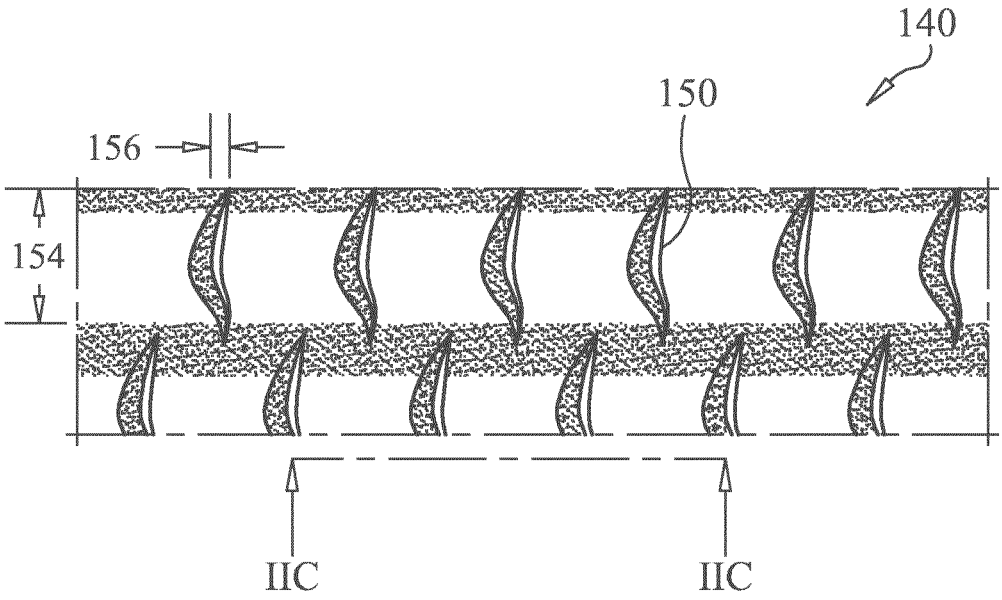
Figure 10C:
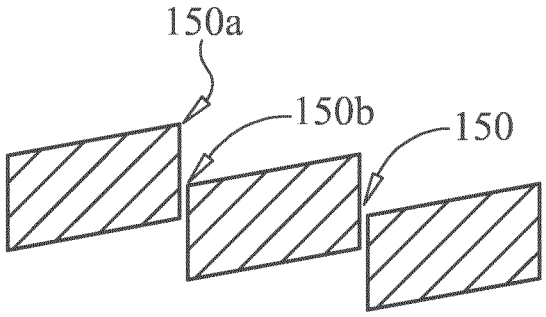

According to the embodiment of FIG. 9, a first wall 20*a* (partly broken away) in the form of a corrugated plate is formed to a cylindrical shape and is placed between a guide means 21 in the form of a circular cylindrical housing 90 (partly broken away), and a first intermediate wall 60*a* (partly broken away) formed to a circular cylindrical shape, however of a smaller diameter than that of the housing 90. Thus, the axial extension of the circular cylindrical housing 90, the first wall 20*a*, the intermediate wall 60*a*, the second wall 20*b* is preferably substantially the same as that of the intermediate wall 60*b*, respectively.

The diameters of the housing 90 and the first intermediate wall 60*a* are chosen such that the ridges 70 if considered needed are allowed to be connected e.g. by gluing to the interior of the housing 90, while the valleys 72 if considered needed are allowed to be connected to exterior of the first intermediate wall 60*a*. Hereby is created a first element 40*a* having a first flow channel 12*a* parallel to an additional first flow channel 12*a'*.

Furthermore, a second wall 20*b* in the form of a corrugated plate is formed to a cylindrical shape and is placed inside said first circular cylindrical intermediate wall 60*a*.

The diameter of the wall 20*b* is chosen such that its ridges 70 if considered needed are allowed to be connected to the interior of the first cylindrical intermediate wall 60*a*, e.g. by gluing. A second circular cylindrical wall 60*b* having a smaller diameter than that of the first cylindrical intermediate wall 60*a*, is placed inside said second wall 20*b*. The diameter of the second cylindrical intermediate wall 60*b* is chosen such that the valleys 72 of the second corrugated cylindrical sheet 20*b* are allowed to be connected to the exterior of the second cylindrical intermediate wall 60*b*, e.g. by gluing or welding if considered needed.

Hereby, a second element 40*b* is created having a second flow channel 16*a* parallel to an additional second flow channel 16*a'*.

The second corrugated cylindrical wall 20*b* is arranged such that the corrugations thereof are substantially at an angle to the corrugations of the first corrugated cylindrical wall 20*a*. Thus the first flow channel 12*a* and its parallel additional first flow channel 12*a*', both for the first flow A are arranged at said angle to the second flow channel 16*a* and its parallel additional second flow channel 16*a*', both for the second flow B.

The angle may be perpendicular, even though it may be in the range 10°-150°, more particular 30°-140°, even more particular 40°-100°, most particular 60°-94°.

In FIG. 9 only two elements 40*a*, 40*b* have been shown, while further elements 40*c*, 40*d* etc. towards the centre of the cylinder have been omitted for better understanding of the figure.

Alternatively, the first and second cylindrical intermediate walls 60*a*, 60*b* shown in FIG. 9 may be excluded. Instead, the first and second corrugated walls 20*a*, 20*b* may be directly connected to one another by connecting the valleys 72 of the first corrugated wall 20*a* perpendicularly to the ridges 70 of the second corrugated sheet wall 20*b* (cf. FIG. 3A).

The number of walls of the different embodiments of the sound damping device described above are interchangeably applicable to the other embodiments, respectively. Likewise, the number of elements of the different embodiments of the sound damping device described above are interchangeably applicable to the other embodiments, respectively. It should be noted that the number of walls may be as few as a single one, forming an intermediate wall of two elements.

In all above described embodiments, one of, a plurality of or all of the walls 20*a*, 20*b* etc. are at least partly provided with a sound energy dissipative sheet material. Of course, it may be completely constituted by a sound energy dissipative sheet material.

The absorption degree of such a sound attenuation element 16 depends i.a. on the perforation degree. It is not difficult to calculate mathematically the perforation degree of a sheet or plate provided with circular holes. However, the perforation degree of a sheet or plate provided with micro-slits or micro-cracks is much more difficult to calculate. It is therefore preferable to measure the airflow resistance in accordance with the accepted method described in ASTM C 522-73 for achieving a comparable size of the perforation degree, utilising the unit $Rayls_{MKS}$ It should in this context be noted that 1 $Rayls_{MKS}$=1 N·s/m$^3$=1 Pa·s/m=1 kg/s·m$^2$.

One kind of a sound energy dissipative sheet material 140 is shown in FIGS. 11A-11C 10A-10C, being in the form of a micro-perforated sheet of plastic or metal, such as stainless steel or aluminium provided with micro-slits 150. The air flow resistance of the micro-perforated sound absorbing element may be 400 $Rayls_{MKS}$, even though it may be in the range 100-10 000 $Rayls_{MKS}$, more particular in the range 200-1000 $Rayls_{MKS}$, even more particular 300-500 $Rayls_{MKS}$.

The micro-slits 150 are of the sound absorbing element are preferably made by cutting the sheet 140 by means of a knife roll having a wavy shape against another edge, hereby resulting in a first slit edge 150*a* and a second slit edge 150*b* partly pressed out of the material plane.

Subsequently, the first and second slit edges 150*a*, 150*b* are pressed back by a subsequent rolling operation. Hereby, micro-slits 150 of a predetermined length 154 and predetermined width 156 are created. The width 156 is preferably in the range $10^{-10}$-$10^{-3}$ m. The length 22 of the micro-slits 18 may be as small as $10^{-10}$ m, but may instead extend in substantially the whole lateral extension of the wall 20*a*, 20*b* etc. comprising, constituted by a single sheet 140.

It should be noted, that cutting may instead be performed by use of laser or a water jet cutter.

The micro-perforations may alternatively be performed as micro-cracks or as through holes of any shape, such as circular, triangular or polygonal. They may on the other hand be constituted by compressed metal fibres or a sintered material or be made of a non-woven or woven material.

Hereby, an acoustic impedance is created by transmission losses between neighbouring channels.

A fluid flow, e.g. by a liquid, such as water, or a gas, such as air in a duct or chamber, will create noise. The noise may in addition be created by use of a pump or a fan connected to the duct or chamber e.g. in a ventilation system or a water in a water cooling system of a ventilation system. The noise may alternatively be created by use of a pump or a fan or a compressor or a combustion engine.

In case of a combustion engine, a muffler is generally arranged inside the exhaust after the manifold. However, the above described sound damping device may even be arranged inside in one, several or all of the tubings of the manifold, providing the advantage that killing the noise at an early stage in the exhaust line will save space in the other end of the line, and thus the exhaust silencer requires less space.

The thickness of the sheet is in the range $10^{-10}$ m-2 mm, more particular $10^{-9}$ m-1 mm, even more particular $10^{-8}$ m-0.9 mm.

It should also be noted that instead of micro-slits 150 the micro-perforated sound absorbing element may be provided with substantially circular through-holes, having a diameter of $10^{-10}$-$10^{-3}$ m.

It should also be noted that the length 154 and width 156 of the micro-slits 150 is chosen in combination with the number of slits (or any other kind of the above described micro-perforations), in such a way that sheet 140 has perforation degree with the above described range of air flow resistance.

The sound damping device 10 according to the invention may be used e.g. in inlets to jet engines, exhaust pipes for vehicles, in chimneys for industries, such as chemical plants.

It should be noted that the sound absorbing device of all embodiments may be provided with a frame 51.

Disregarding the use of the sound damping device according to the invention, it is important to reduce the flow resistance, such that the fluid flow is substantially not affected.

Consequently, in order to reduce transmission losses, the reduction of the cross-section is to be kept low.

By choosing the thickness and/or number of the walls, it is possible to achieve a total cross-sectional area of the flow channels of the elements of at least 70% of the cross-sectional area of said stack in order to. Hereby, a low flow resistance is achieved. On the other hand, by choosing a predetermined shape of the walls, it is possible to achieve a total cross-sectional area of the flow channels of at least 90% of the cross-sectional area of said stack. Depending of the number of walls chosen, it is however possible to achieve total cross-sectional area of the flow channels of at least 95%, or even more than 97%.

Example

A ventilation duct has a cross-section of 15 cm*15 cm. A sound damping device 10 in accordance with the invention is provided in the duct 100 in the manner as shown in FIG. 7.

A stack of plates 20*a*-20*e* have a thickness of 1 mm, hereby forming six flow channels (cf. FIG. 1B).

The cross-section of the duct is, 15*15 cm=225 $cm^2$, and the thickness of the five plates together is 5 mm. Thus, the cross-sectional area of the five plates together is 15 cm*0.5 cm=7.5 $cm^2$.

Consequently, the relation between the cross-sectional area of the duct and the total cross-sectional area of the flow channels of the stack is (225-7.5)/225=0.97, i.e. 97%.

First and third channels 12*a*, 12*b* are arranged perpendicularly to second and fourth channels 16*a*, 16*b* and in relation to the general flow G of the duct such that the first flow A as well as the second flow B is 45° in relation to the general flow G.

By the angled channels 12*a*, 12*b*, 16*a*, 16*b* in relation to the general flow direction G, sound energy losses are achieved directly in the channels, since the inlet of first, second, third and fourth all channels are all inclined in relation to the general flow of the duct.

Furthermore, since the plates are made of a micro-perforated material, sound energy losses will occur due to pressure differences between the channels 12*a*, 12*b*, 16*a*,16*b* through the micro-perforations.

REFERENCE SIGNS USED

A first flow
B second flow
G general flow
sound damping device
11*a* inlet region
11*b* outlet region
12*a* first flow channel
12*a*' additional first flow channel
12*b* third flow channel
12*b*' additional third flow channel
12*c* fifth flow channel
12*c*' additional fifth flow channel
13*a* first channel inlet
13*b* first channel outlet
14*a* second channel inlet
14*b* second channel outlet
15*a* third channel inlet

15*b* third channel outlet
16*a* second flow channel
16*a*' additional second flow channel
16*b* fourth flow channel
16*b*' additional fourth flow channel
16*c* sixth flow channel
17*a* fourth channel inlet
17*b* fifth channel outlet
20*a*-20*g* wall
21 guide means
22*a*, 22*b* first and third sealing means
23*a*, 23*b* second and fourth sealing means
24*a*, 24*b* peripheral region
40*a* first element
40*b* second element
40*c* third element
40*d* fourth element
40*e* fifth element
50 distance holding member
51 frame
52 fold
60*a*-60*d* intermediate wall
61 end plate
70 ridge
70' positive bump
72 valleys
72' negative bump
90 circular cylindrical housing
91*a*, 91*b* open end
92 circular cylindrical unit
100 duct
140 sheet
150 micro-slits
28
150*a* first slit edge
150*b* second slit edge
154 length
156 width

The invention claimed is:

1. A sound damping device adapted to be arranged inside a duct, the sound damping device comprising:

a first element including at least one first wall of a first channel having a first channel inlet and a first channel outlet; and a second element including at least one second wall of a second channel having a second channel inlet and a second channel outlet, wherein said first and second elements together form a stack or roll having an inlet region and an outlet region, said inlet and outlet regions being substantially opposite to one another, wherein at least a portion of at least one of said first and second elements comprises an acoustic energy dissipative sheet material, wherein said first element comprises a first guide means further defining said first channel, wherein said second element comprises a second guide means further defining said second channel, and wherein said first and second guide means are arranged in relation to one another such that the first channel forms a first angle in relation to the second channel, wherein the first angle is a non-zero angle, wherein said first guide means comprises a first guide member close to the first channel inlet and a further first guide member close to the first channel outlet, wherein said second guide means comprises a second guide member close to the second channel inlet and a further second guide member close to the second channel outlet, wherein said first guide member and said further first guide member of said first guide means together define said first channel laterally, and wherein said second guide member and said further second guide member of said second guide means together define said second channel laterally.

2. The sound damping device of claim 1, wherein the total cross-sectional area of the first channel and the second channel corresponds substantially to that of the cross-sectional area of the duct inside which the sound damping device is adapted to be mounted, such that the sound damping device does not cause a substantial pressure drop from the first and second channel inlet to the first and second channel outlets, respectively.

3. The sound damping device of claim 1 wherein the first angle is in the range of 10°-150°.

4. The sound damping device of claim 1, further comprising:

a third element including at least one third wall of a third channel having a third channel inlet and a third channel outlet;

a fourth element including at least one fourth wall of a fourth channel having a fourth channel inlet and a fourth channel outlet, wherein said third and fourth elements together form a stack or roll together with the said first and second elements, wherein at least a portion of at least one of said third and fourth elements comprises an acoustic energy dissipative sheet material, wherein said third element comprises a third guide means further defining said third channel, wherein said fourth element comprises a fourth guide means further defining said fourth channel, wherein said third element is arranged in relation to said second element in such a way that the third channel forms a second angle in relation to the second channel, and wherein said fourth element is arranged in relation to said third element in such a way that the third channel forms a third angle in relation to the fourth channel.

5. The sound damping device of claim 4, wherein the first and third channels are directed in substantially the same direction, and wherein the second and fourth channels are directed in substantially the same direction.

6. The sound damping device of claim 4:

wherein said third guide means comprises a third guide member close to the third channel inlet, wherein said fourth guide means comprises a fourth guide member close to the fourth channel inlet, wherein said third guide means comprises a further third guide member close to the third channel outlet, and wherein said fourth guide means comprises a further fourth guide member close to the fourth channel outlet.

7. The sound damping device of claim 6, wherein said third guide member and said further third guide member of said third guide means together define said third channel laterally, and wherein said fourth guide member and said further fourth guide member of said fourth guide means together define said fourth channel laterally.

8. The sound damping device of claim 4, wherein the second angle is in the range of 10°-150°.

9. The sound damping device of claim 1, wherein at least one of said first or second elements includes the wall of a neighboring element.

10. The sound damping device of claim 1, wherein at least one of said first or second elements includes an intermediate wall separating said element from a neighboring element.

11. The sound damping device of claim 1, wherein the first wall is provided with protrusions and/or indentations, constituting distance holding members in relation to a neighboring wall.

12. The sound damping device of claim 11, wherein the protrusions and/or indentations are arranged such that the total cross-sectional area of said channels is substantially constant.

13. The sound damping device of claim 1, further comprising a housing or frame adapted to support said stack or roll, said housing or frame being adapted to fit inside said duct.

14. The sound damping device of claim 13, wherein said housing or frame is adapted to keep the stack or roll inside said duct in such a way that a bisector of the inlets of the first and second channels is directed substantially in the flow direction of said duct.

15. The sound damping device of claim 1, wherein the total cross-sectional area of the channels of the elements is at least 70% of the cross-sectional area of said stack.

16. The sound damping device of claim 1, wherein said first and second walls are formed as plates, said plates being shaped as a parallelogram or a disc.

17. The sound damping device of claim 1, wherein said acoustic energy, dissipative sheet material is made of any one of: plastic, metal, hard metal and ceramics.

18. The sound damping device of claim 1, wherein said acoustic energy dissipative sheet material is micro-porous.

19. The sound damping device of claim 1, wherein said acoustic energy dissipative sheet material is provided with micro-perforations, such as micro-slits.

20. The sound damping device of claim 18, wherein said acoustic energy dissipative sheet material comprises sintered metal or sintered cemented carbide.

21. The sound damping device of claim 18, wherein the thickness of said acoustic energy dissipative sheet material is in the range of $10^{-9}$ m-2 mm.

22. The sound damping device of claim 18, wherein the air flow resistance of said acoustic energy dissipative sheet material is in the range of 100-10 000 $\text{Rayl}_{SMKS}$.

23. The sound damping device of claim 1, wherein said acoustic energy dissipative sheet material comprises a membrane damping material in the form of a non-perforated sheet, the thickness of which is in the range of $10^{-9}$ m-1 mm.

24. The sound damping device of claim 4, wherein said second, third and fourth angles are substantially 90°.

25. The sound damping device of claim 1, v herein said first angle is substantially 90°.

26. The sound damping device of claim 1, wherein the first angle is in the range of 30°-140°.

27. The sound damping device of claim 1, wherein the first angle is in the range of 40°-100°.

28. The sound damping device of claim 1, wherein the first angle is in the range of 60°-94°.

29. The sound damping device of claim 4, wherein the second angle is in the range of 30°-140°.

30. The sound damping device of claim 4, wherein the second angle is in the range of 40°-100°.

31. The sound damping device of claim 4, wherein the second angle is in the range of 60°-94°.

32. The sound damping device of claim 1, wherein the total cross-sectional area of the channels of the elements is at least 90% of the cross-sectional area of said stack.

33. The sound damping device of claim 1, wherein the total cross-sectional area of the channels of the elements is at least 95% of the cross-sectional area of said stack.

34. The sound damping device of claim 1, wherein the total cross-sectional area of the channels of the elements is at least 97% of the cross-sectional area of said stack.

35. The sound damping device of claim 18, wherein the thickness of said acoustic energy dissipative sheet material is in the range of $10^{-8}$ m-1 mm.

36. The sound damping device of claim 18, wherein the thickness of said acoustic energy dissipative sheet material is in the range of $10^{-7}$ m-0.9 nm.

37. The sound damping device of claim 18, wherein the air flow resistance of said acoustic energy dissipative sheet material is in the range of 200-1000 $\text{Rayl}_{SMKS}$.

38. The sound damping device of claim 18, wherein the air flow resistance of said acoustic energy dissipative sheet material is in the range of 300-500 $\text{Rayl}_{SMKS}$.

39. The sound damping device of claim 1, wherein said acoustic energy dissipative sheet material comprises a membrane damping material in the form of a non-perforated sheet, the thickness of which is in the range of $10^{-8}$ m-0.7 mm.

40. The sound damping device of claim 1, wherein said acoustic energy dissipative sheet material comprises a membrane damping material in the form of a non-perforated sheet, the thickness of which is in the range of $10^{-7}$ in-0.5 mm.

41. The sound damping device of claim 9, wherein the protrusions and/or indentations are arranged such that the total cross-sectional area of said channels is substantially constant.

42. The sound damping device of claim 10, wherein the protrusions and/or indentations are arranged such that the total cross-sectional area of said channels is substantially constant.

43. A sound damping device adapted to be arranged inside a duct having a general flow direction, the sound damping device comprising:

a plurality of first elements, each first element including at least one first wall of a first channel having a first inlet and a first outlet; and a plurality of second elements, each including at least one second wall of a second channel having a second inlet and a second outlet, wherein each of said first and second elements are arranged together in an alternating pattern forming a stack or roll having an inlet region and an outlet region, said inlet and outlet regions being substantially opposite to one another, wherein at least a portion of at least one plurality of said first and second elements comprises an acoustic energy dissipative sheet material, wherein each first element comprises a first guide means further defining each first channel, wherein each second element comprises a second guide means further defining each second channel, wherein said first and second guide means are arranged in relation to one another such that the first channels form a first angle in relation to the second channels, and wherein the first angle is a non-zero angle.

44. The sound damping device of claim 43, wherein at least every second wall is provided with protrusions and/or indentations, constituting distance holding members in relation to a neighboring wall.

* * * * *